US006332314B1

(12) United States Patent
Nakade et al.

(10) Patent No.: US 6,332,314 B1
(45) Date of Patent: Dec. 25, 2001

(54) CATALYZER ARRANGEMENT IN EXHAUST SYSTEM OF MULTI-CYLINDER INTERNAL COMBUSTION ENGINE

(75) Inventors: Junichi Nakade; Takeshi Kurotobi; Masahiro Sakanushi; Fumihiko Maeda, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/715,037

(22) Filed: Nov. 20, 2000

(30) Foreign Application Priority Data

Nov. 24, 1999 (JP) ..... 11-332505

(51) Int. Cl.[7] ..... F01N 3/10

(52) U.S. Cl. ..... 60/299; 60/313; 60/322; 60/323; D12/194

(58) Field of Search ..... 60/322, 323, 272, 60/282, 312, 313, 314, 299, 300; D12/194, 114

(56) References Cited

U.S. PATENT DOCUMENTS 2,727,355 * 12/1955 Wosika ..... 60/29
3,631,792 * 1/1972 Bodine ..... 60/30 R
4,671,059 * 6/1987 Lawson ..... 60/309
5,729,973 * 3/1998 Zander et al. ..... 60/302
5,937,640 * 8/1999 Krzykowski et al. ..... 60/284
6,052,990 * 4/2000 Gecker, Jr. ..... 60/312

FOREIGN PATENT DOCUMENTS 6-101462 4/1994 (JP) .

* cited by examiner

*Primary Examiner*—Thomas Denion
*Assistant Examiner*—Binh Tran
(74) *Attorney, Agent, or Firm*—Armstrong, Westerman, Hattori, McLeland & Naughton, LLP

(57) ABSTRACT

In a catalyzer arrangement in an exhaust system of a multi-cylinder internal combustion engine, each of exhaust pipes connected with exhaust ports of the engine has a first exhaust pipe section extending away from a main body of the engine, a second exhaust pipe section contiguous to the first exhaust pipe section having a first curved portion for turning the second exhaust pipe section toward the main body of the engine, and a third exhaust pipe section contiguous to the second exhaust pipe section having a second curved portion for turning the third exhaust pipe portion away from the main body of the engine. A catalyzer is connected to a downstream side of the third exhaust pipe section and disposed within a space surrounded by the first, second and third exhaust pipe sections. The exhaust pipes are divided into one group positioned near one end of a row of cylinder of the engine and another group positioned near another end of the row of cylinder. Exhaust pipes of the one group and exhaust pipes of the another group are collected into respective collective exhaust pipes at a portion extending over the second and third exhaust pipe sections or at the third exhaust pipe section.

7 Claims, 20 Drawing Sheets

CATALYZER ARRANGEMENT IN EXHAUST SYSTEM OF MULTI-CYLINDER INTERNAL COMBUSTION ENGINE

BACKGROUND OF THE INVENTION

The present invention relates to a catalyzer arrangement in an exhaust system of a multi-cylinder internal combustion engine, particularly relates to an improvement of a catalyzer arrangement in an exhaust system of a multi-cylinder internal combustion engine for raising output of the internal combustion engine while lowering emission.

Hitherto, an exhaust system of a multi-cylinder internal combustion engine having a catalyzer arranged midway of an exhaust pipe has been known by Japanese Laid-Open Patent Publication Hei 6-10146. This exhaust system comprises an exhaust manifold, a catalyzer provided on a downstream side of the exhaust manifold and an exhaust pipe provided on the downstream side of the catalyzer. The catalyzer is so formed that exhaust gas discharged from the exhaust manifold flows in parallel with an output shaft of the engine, and the exhaust pipe is directed in a predetermined direction so as to discharge the exhaust gas into the atmosphere.

In the above-mentioned exhaust apparatus, an exhaust manifold having an exhaust pipe length (single pipe length) effective for the output and a catalyzer for purification of exhaust gas are provided in a limited space of an engine room to raise output of the engine while lowering emission.

However, according to the above exhaust apparatus, in case of an exhaust system in which a plurality of exhaust pipes (four exhaust pipes for example) connected to exhaust ports of an engine are collected into a collective exhaust pipe (exhaust system of 4–1 construction), it is difficult to ensure an exhaust pipe length sufficient for reducing exhaust gas interference accompanying high output of the engine within a space limited by breadth of the engine.

If it is intended to ensure a sufficient exhaust pipe length, it becomes difficult to ensure a space for arranging the catalyzer or to ensure a sufficient catalyzer capacity. In addition, since a distance between the exhaust port of the engine and the catalyzer becomes long, the catalyzer takes much time to reach the minimum active temperature and emission is increased.

The above circumstance is similar about an exhaust system in which a plurality of exhaust pipes (four exhaust pipes for example) connected with exhaust ports of an engine are collected into intermediate collective exhaust pipes every two pipes then the intermediate collective exhaust pipes are collected into a final collective exhaust pipe (exhaust system of 4–2 construction). Anyway, until now, it was difficult that high output and low emission are made compatible in an internal combustion engine.

SUMMARY OF THE INVENTION

A subject of the present invention is to solve the above-mentioned problem of the customary catalyzer arrangement in an exhaust system of a multi-cylinder internal combustion engine and provide a novel catalyzer arrangement in an exhaust system of a multi-cylinder internal combustion engine in which exhaust pipe length of an exhaust manifold can be set freely, a sufficient space for arranging a catalyzer can be ensured, performance of the catalyzer can be maintained highest always, and therefore high engine output and low emission can be made compatible.

The present invention provides a catalyzer arrangement in an exhaust system of a multi-cylinder internal combustion engine having a plurality of exhaust pipes connected with exhaust ports of the engine, wherein each of the exhaust pipes has a first exhaust pipe section extending away from a main body of the engine; a second exhaust pipe section contiguous to the first exhaust pipe section having a first curved portion for turning the second exhaust pipe section to the main body of the engine; and a third exhaust pipe section contiguous to the second exhaust pipe section having a second curved portion for turning the third exhaust pipe section away from the main body of the engine, and the catalyzer is connected to a downstream side of the third exhaust pipe section and disposed within a space surrounded by the first, second and third exhaust pipe sections.

According to the invention, since the catalyzer is disposed within a space surrounded by the first exhaust pipe section, the second exhaust pipe section having the first curved portion, and the third exhaust pipe section having the second curved portion, pipe lengths of the exhaust pipes can be set freely within a space limited by breadth of the engine, by suitably selecting curvatures of the curved portions. Therefore, the exhaust pipe length can be matched with valve timing or the like easily, an exhaust pipe length sufficient for reducing exhaust gas interference accompanying high output of the engine can be ensured easily so that output of the engine can be made high. In addition, the construction of the exhaust pipe around the catalyzer can be simplified and made compact.

The catalyzer can be disposed within the space limited by breadth of the engine utilizing a dead space with high space efficiency and a sufficient catalyzer capacity can be ensured easily by adjusting curvature of the curved portion. Therefore, emission can be lowered easily, and emission deterioration characteristic is improved because thermal load per one catalyzer is reduced.

The distance from the exhaust port of the engine to the catalyzer becomes long, but since the catalyzer is surrounded by the exhaust pipes and receives heat from the exhaust pipes, time required for the catalyzer to reach the minimum active temperature is not prolonged even if the engine is started at a low temperature. Therefore, exhaust emission can be reduced.

The exhaust pipes may be divided into one group positioned near one end of a row of cylinder of the engine and another group positioned near another end of the row of cylinder, the catalyzer may be divided into one unit catalyzer positioned near one end of the row of cylinder and another unit catalyzer positioned near another end of the row of cylinder, the one group of cylinders may be connected to the one unit catalyzer, and the another group of cylinders may be connected to the another unit catalyzer.

As the result, since the both unit catalyzers deteriorate equally and each unit catalyzer deteriorates uniformly, endurance of the catalyzer is improved to enable to utilize the catalyzer effectively.

At least one of the first and second exhaust pipe sections may have a portion contacted with at least one of a connecting portion of the third exhaust section to the catalyzer and the catalyzer itself.

As the result, since the catalyzer receives heat from exhaust gas on an upstream side of the catalyzer more efficiently by thermal conduction through the contacted portion, active temperature of the catalyzer can be maintained surly, time required for the catalyzer to reach the minimum active temperature is shortened, and exhaust emission is further lowered.

The exhaust pipes may be divided into one group positioned near one end of a row of cylinder of the engine and another group positioned near another end of the row of cylinder, and in each of the group, two exhaust pipes may be collected into a collective exhaust pipe at a portion extending over the second and third exhaust pipe sections or at the third exhaust pipe section.

As the result, length of each exhaust pipe can be set freely by changing the position where the two exhaust pipes are collected into the one collective exhaust pipe. Therefore, the exhaust pipe length can be matched with valve timing or the like more easily, and exhaust gas interference accompanying high output of the engine can be further reduced, so that output of the engine can be made higher.

The catalyzer may be divided into one unit catalyzer positioned near one end of the row of cylinder and another unit catalyzer positioned near another end of the row of cylinder, the collective exhaust pipe in the one group may be connected to the one unit catalyzer, and the collective exhaust pipe in the another group may be connected to the another unit catalyzer.

As the result, since the both unit catalyzers deteriorate equally and each unit catalyzer deteriorates uniformly, endurance of the catalyzer is improved to enable to utilize the catalyzer effectively.

At least one of the first and second exhaust pipe sections may have a portion contacted with at least one of connecting portion of the collective exhaust pipe to the catalyzer and the catalyzer itself.

As the result, since the catalyzer receives heat of the exhaust gas on upstream side of the catalyzer by thermal conduction through the contacted portion further efficiently, active temperature of the catalyzer can be maintained more surely, time required for the catalyzer to reach the minimum active temperature is more shortened, and exhaust emission is further lowered.

According to another aspect of the invention, there is provided a catalyzer arrangement in an exhaust system of a multi-cylinder internal combustion engine having a plurality of exhaust pipes connected with exhaust ports of the engine, wherein each of the exhaust pipes has a first exhaust pipe section extending from a main body of the engine upward or downward in parallel with the main body; a second exhaust pipe section contiguous to the first exhaust pipe section having a first curved portion for turning the second exhaust pipe section away from the main body; and a third exhaust pipe section contiguous to the second exhaust pipe section having a second curved portion for turning the third exhaust pipe section toward the main body, and the catalyzer is connected to a downstream side of the third exhaust pipe section and disposed within a space surrounded by the first, second and third exhaust pipe sections.

Since the catalyzer is disposed within a space surrounded by the first exhaust pipe section, the second exhaust pipe section having the first curved portion and the third exhaust pipe section having the second curved portion, pipe lengths of the exhaust pipes can be set freely within a space limited by breadth of the engine, by suitably selecting curvatures of the curved portions. Therefore, the exhaust pipe length can be matched with valve timing or the like easily, and an exhaust pipe length efficient for reducing exhaust gas interference accompanying high output of the engine can be ensured easily so that the output of the engine can be made high.

The catalyzer can be disposed within the space limited by breadth of the engine utilizing a dead space with high space efficiency and a sufficient catalyzer capacity can be ensured easily by adjusting curvature of the curved portion. Therefore, emission can be lowered easily, and emission deterioration characteristic is improved because thermal load per one catalyzer is reduced.

The distance from the exhaust port of the engine to the catalyzer becomes long, but since the catalyzer is surrounded by the exhaust pipes and receives heat from the exhaust pipes, time required for the catalyzer to reach the minimum active temperature is not prolonged even if the engine is started at a low temperature. Therefore, exhaust emission can be reduced.

DETAILED DESCRIPTION OF THE PREFERRED EMBODIMENT

Hereinafter, an embodiment (embodiment I) of the present invention will be described with reference to FIGS. 1 to 7.

Figure 1:
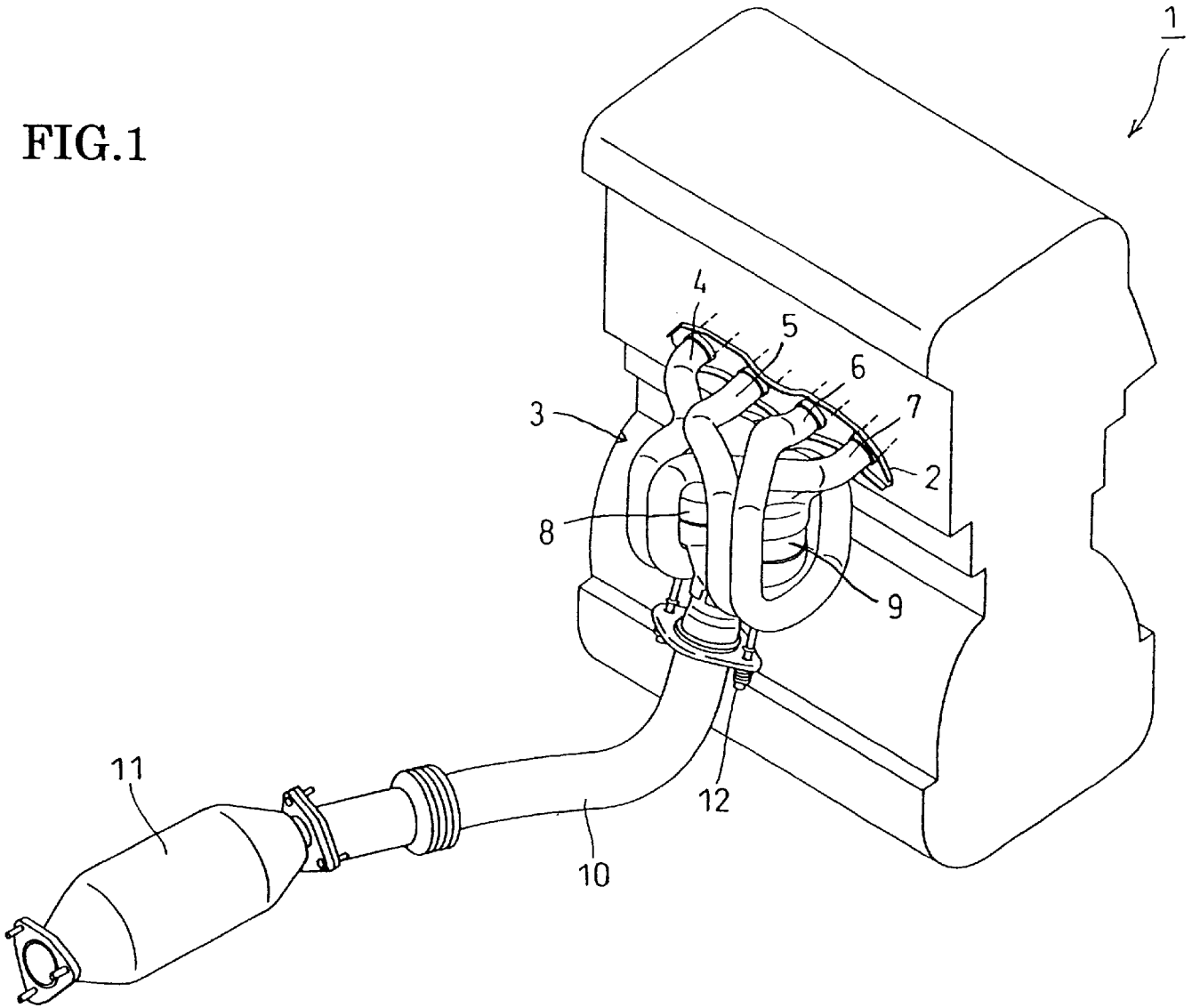
FIG. 1 is a perspective view of an exhaust system of a multi-cylinder internal combustion engine according to the first embodiment of the present invention (embodiment I)
Figure 2:
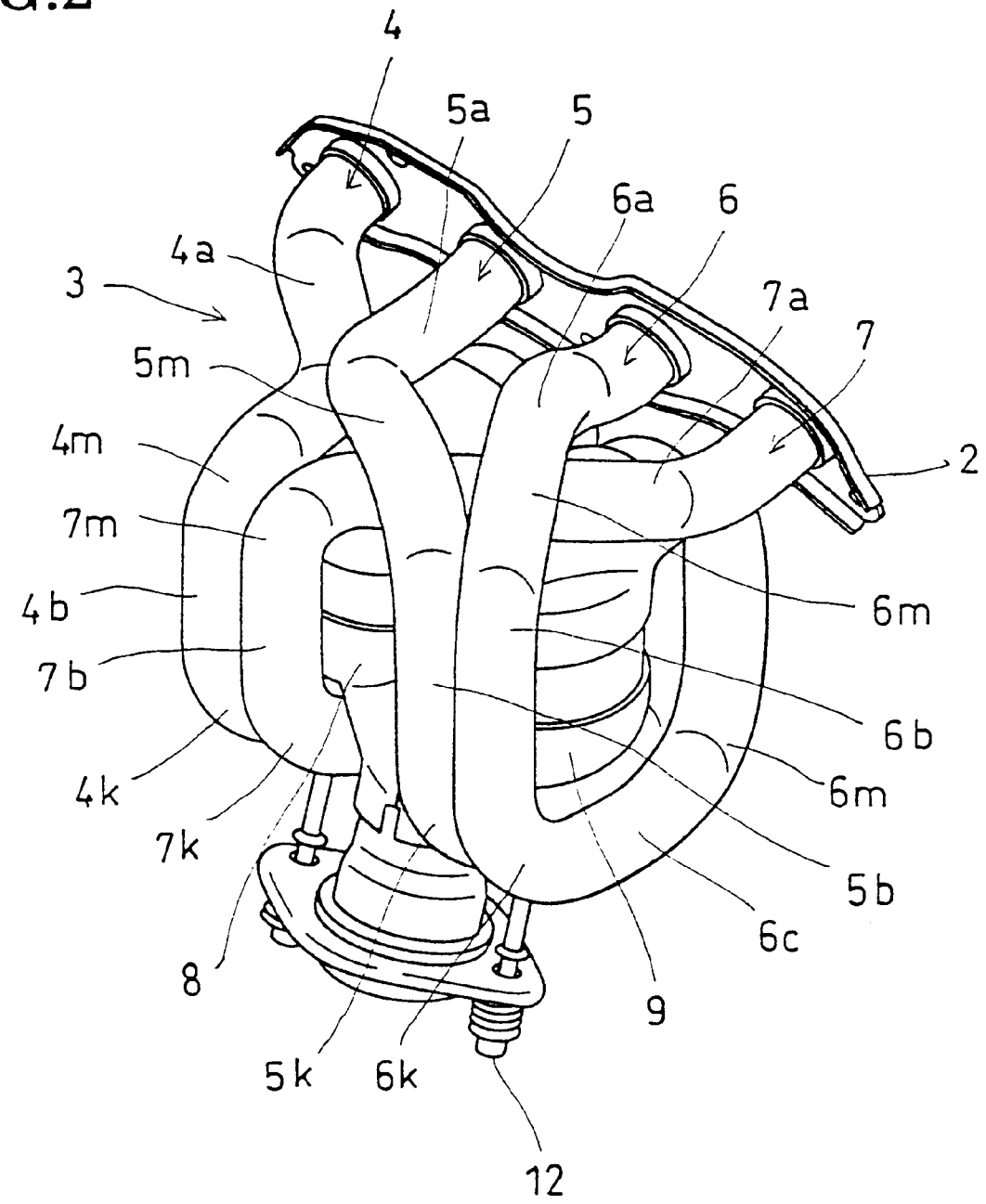
FIG. 2 is a perspective view of a catalyzer arrangement in the exhaust system.
Figure 3:
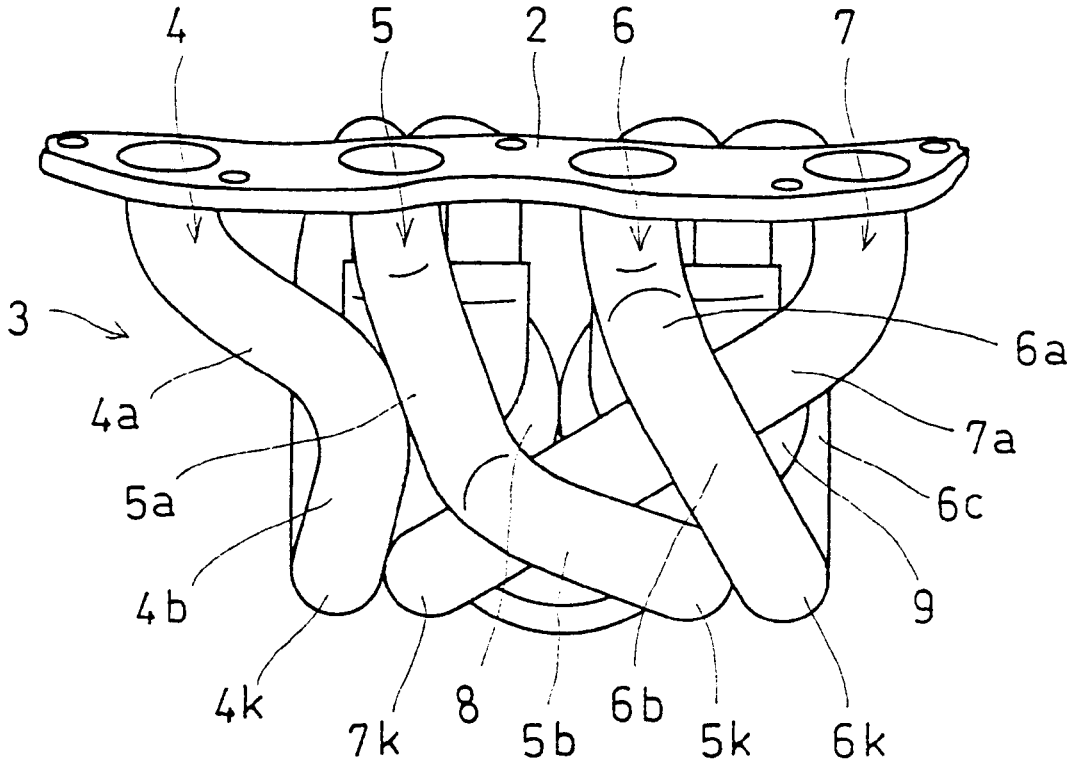
FIG. 3 is a plan view thereof.
Figure 4:
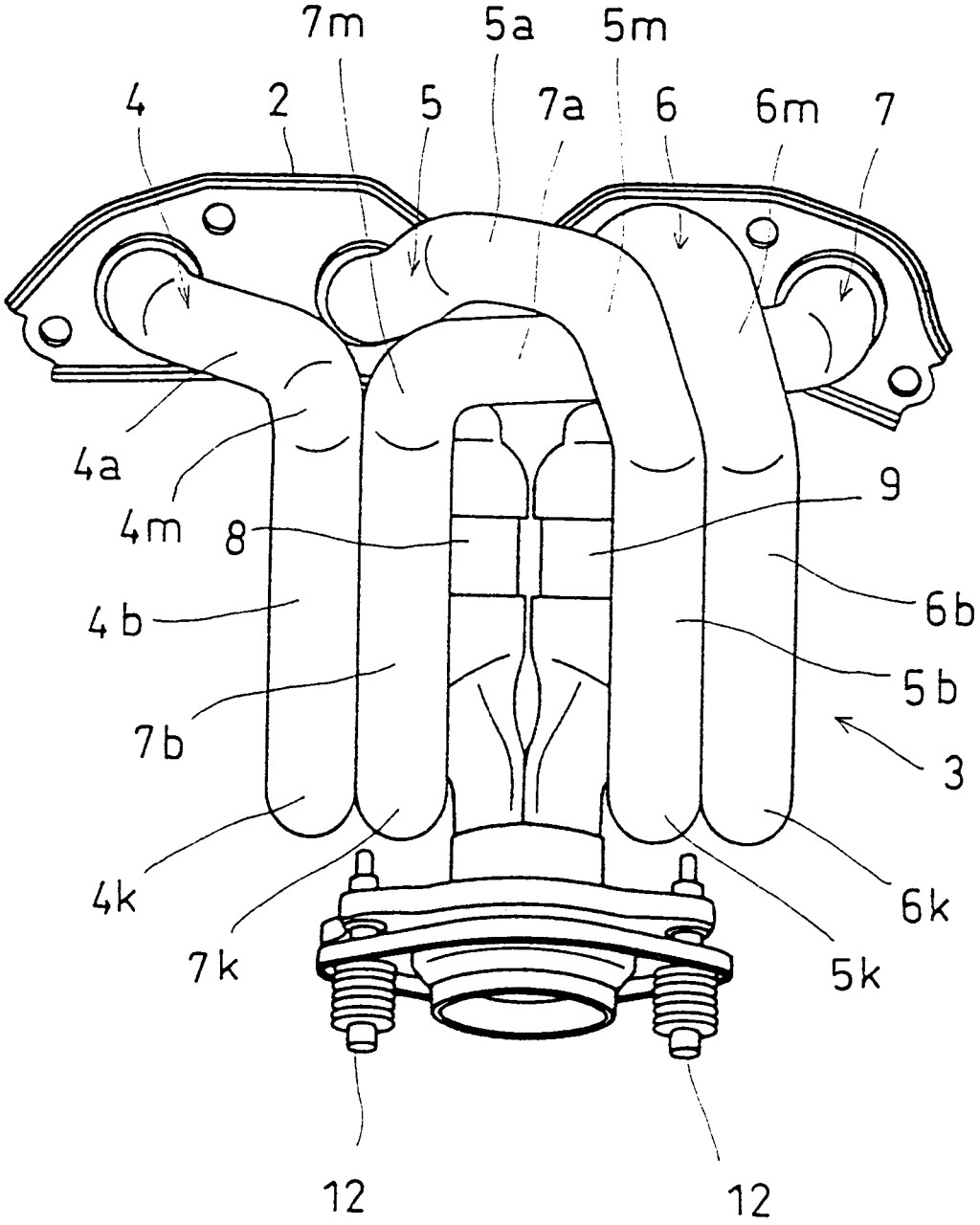
FIG. 4 is a rear view thereof.
Figure 5:
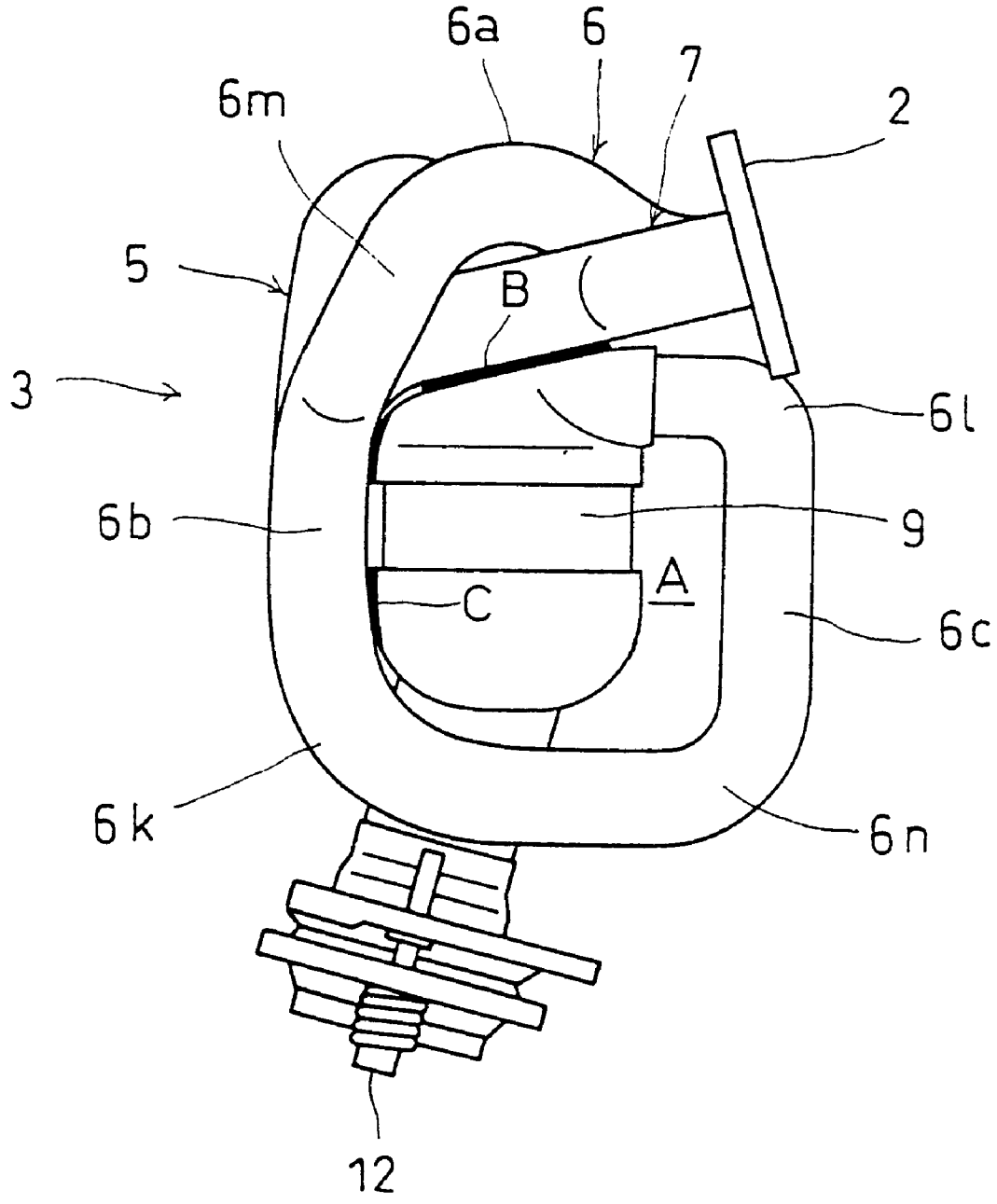
FIG. 5 is a right side view of FIG. 4.
Figure 6:
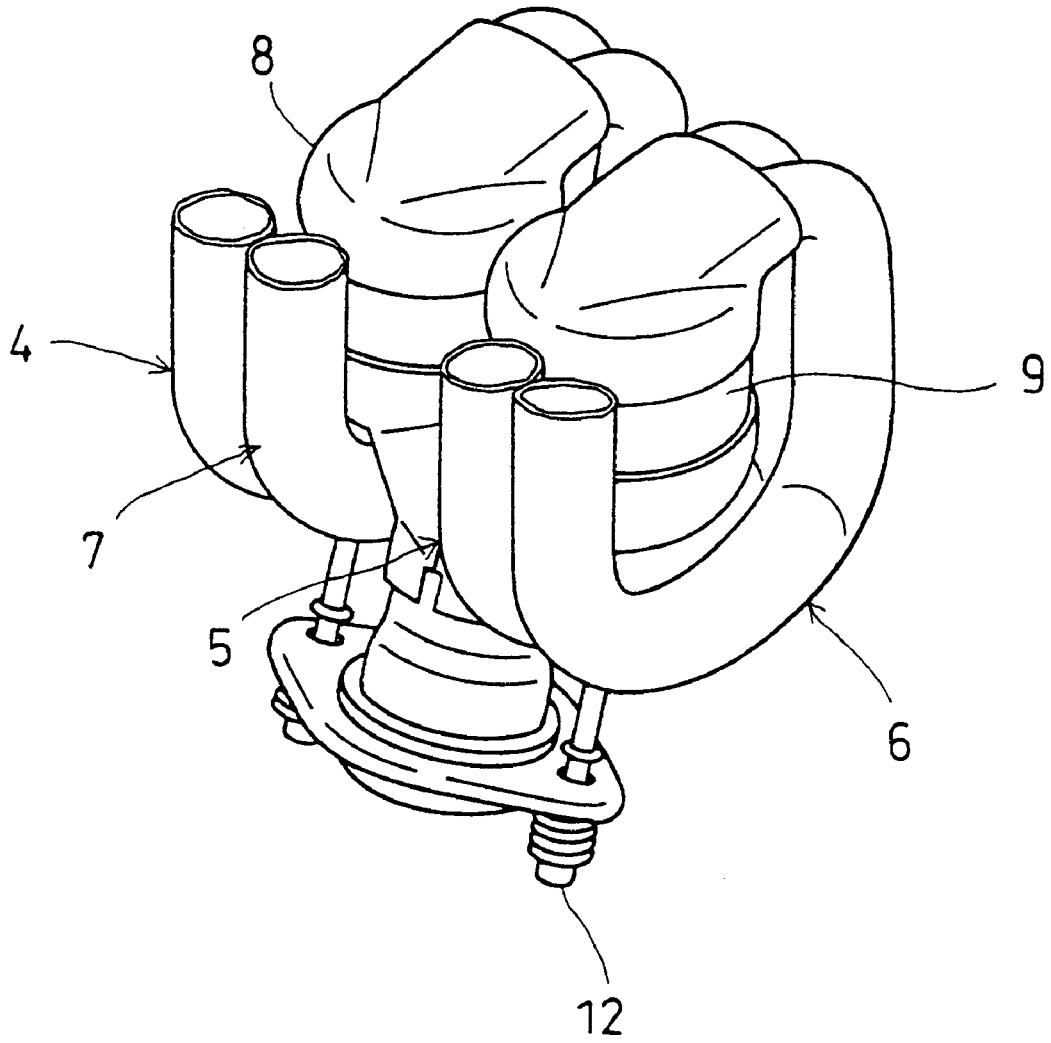
FIG. 6 is a partial perspective view of the catalyzer arrangement.
Figure 7:
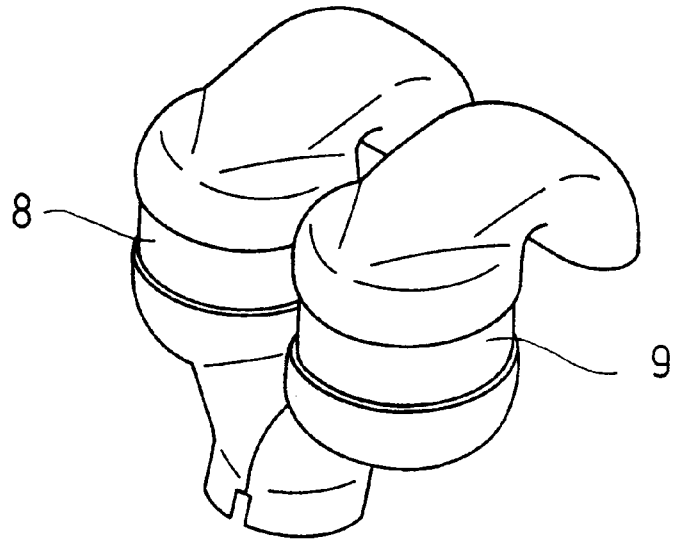
FIG. 7 is a perspective view of the catalyzer.

FIG. 1 is a perspective view of an exhaust system of a multi-cylinder internal combustion engine according to the embodiment I, FIG. 2 is a perspective view of a catalyzer arrangement in the exhaust system, FIG. 3 is a plan view of the catalyzer arrangement, FIG. 4 is a rear view of the catalyzer arrangement, FIG. 5 is a right side view of FIG. 4, FIG. 6 is a partial perspective view of the catalyzer arrangement, and FIG. 7 is a perspective view of the catalyzer.

As shown in FIGS. 1 to 5, the internal combustion engine 1 applied with the catalyzer arrangement according to the embodiment I is a spark-ignition water-cooled 4-cycle straight-type 4-cylinder internal combustion engine to be mounted on a vehicle. The engine 1 has four exhaust ports arranged on a rear side (rear with respect to the vehicle) of a cylinder head corresponding to respective four cylinders. Exhaust pipes 4 to 7 constituting an exhaust manifold 3 are connected with the respective exhaust ports through an attachment plate which is common to the exhaust ports.

The exhaust pipes 4 to 7 are divided into two groups so that each two exhaust pipes in each group are connected with the respective cylinders having firing interval of 180 degrees. One group of the cylinders is positioned near one end of a row of cylinder of the engine (near the left side in FIG. 1), and another group is positioned near another end of the row of cylinder (near the right side in FIG. 1). The exhaust pipes of the above-mentioned one group are connected to an unit catalyzer 8 positioned near one end of the row of cylinder and the exhaust pipes of the above-mentioned another group are connected to an unit catalyzer 9 positioned near another end of the row of cylinder. In the embodiment I, the exhaust pipes 4 and 7 are collected in the position near one end of the row of cylinder and the exhaust pipes 5 and 6 are collected in the position near another end of the row of cylinder.

Connecting portions of the exhaust pipes 4 to 7 to the unit catalyzers 8, 9 are constructed as follows.

Each of the exhaust pipes 4 to 7 has a first exhaust pipe section (4*a*–7*a*) extending rearward away from the main body of the engine, a second exhaust pipe section (4*b*–7*b*) contiguous to the first exhaust pipe section having a first curved portion (4*k*–7*k*) for turning the second exhaust pipe section foreward toward the main body of the engine, and a third exhaust pipe section (4*c*–7*c*) contiguous to the second exhaust pipe section having a second curved portion (41–71) for turning the third exhaust pipe section rearward away from the main body of the engine. In this specification, the second exhaust pipe sections 4*b*–7*b* mean portions of the exhaust pipes 4–7 including the first curved portions 4*k*–7*k* through which the exhaust pipes 4–7 finally turn toward the main body of the engine, but it is unnecessary to define exactly both ends of the second exhaust pipe sections 4*b*–7*b*.

As shown in FIGS. 1 to 4, the first exhaust pipe sections 4*a*–7*a* are suitably curved so as to form the aforementioned respective groups at positions near one and another ends of the row of cylinder.

In the first curved portions 4*h*–7*h*, the exhaust pipes 4–7 change the direction toward the main body of the engine extending downward from a cylinder head side to a crankcase side. In the second curved portions 41–71, the exhaust pipes 4–7 change the direction away from the main body of the engine extending upward from the crankcase side to the cylinder head side.

With regard to the exhaust pipe 6, its all portions 6*a*–6*l* are shown in FIGS. 2 to 5. Therefore, the construction of the exhaust pipe 6 will be described further in detail. Since the constructions of the exhaust pipes 4, 5, 7 are similar to the exhaust pipe 6 basically, detailed description of the exhaust pipes 4, 5, 7 is omitted and some parts of the exhaust pipes 4, 5, 7 are not affixed with reference letters in the figures.

The exhaust pipe 6 has the first exhaust pipe section 6*a* extending rearward away from the main body of the engine, the second exhaust pipe section 6*b* contiguous to the first exhaust pipe section 6*a* having the first curved portion 6*k* for turning the second exhaust pipe section 6*b* forward toward the main body of the engine, and the third exhaust pipe section 6*c* contiguous to the second exhaust pipe section 6*b* having the second curved portion 61 for turning the third exhaust pipe section 61 rearward away from the main body of the engine. And downstream side of the third exhaust pipe section 6*c* is connected with the catalyzer 9.

The exhaust pipe 6 has an additional curved portion 6*m* at a position shifting from the first exhaust pipe section 6*a* to the second exhaust pipe section 6*b* and further additional curved portion 6*n* at a position shifting from the second exhaust pipe section 6*b* to the third exhaust pipe section 6*c*. These curved portions 6*m*, 6*n* are excluded from the first and second curved portions 6*k*, 61 because the curved portions 6*m*, 6*n* do not turn direction of the exhaust pipe 6.

The exhaust pipes 4–7 having the first, second and third exhaust pipe sections 4*a*–7*a*, 4*b*–7*b* and 4*c*–7*c* each formed as mentioned above, present a side view of a spiral wound counterclockwise as shown in FIG. 5. And the catalyzer is disposed in a space A surrounded by the first, second and third exhaust pipe sections. In this embodiment I, the catalyzer is divided into two unit catalyzers 8, 9.

The space A is formed in a cylindrical shape parallel with the row of cylinder of the engine and has open ends. The unit catalyzers 8, 9 disposed in the space A are also arranged in parallel with the row of cylinder. The unit catalyzer 8 is positioned near one end of the row of cylinder (left upper side in FIGS. 1, 2), and the unit catalyzer 9 is positioned near another end of the row of cylinder (right lower side in FIGS. 1, 2)

The third exhaust pipe sections 4*c*, 7*c* of the exhaust pipes 4, 7 collected in a position near one end of the row of cylinder are connected to the unit catalyzer positioned near the same end of the row of cylinder. The third exhaust pipe sections 5*c*, 6*c* of the exhaust pipes 5, 6 collected in a position near another end of the row of cylinder are connected to the unit catalyzer 9 positioned near the same end of the row of cylinder.

Since the unit catalyzers 8, 9 are positioned near a heated portion of the main body of the engine, they receive radiation heat from the main body of the engine as well as radiation heat from the exhaust pipes 4–7, so that the active temperature is maintained and time required for reaching the minimum active temperature can be shortened. In this specification, the term "catalyzer" is used as a general name of a catalyst substance and a receptacle thereof.

As shown in FIG. 5, at least one of the first exhaust pipe sections 4*a*–7*a* and the second exhaust pipe sections 4*b*–7*b* of the exhaust pipes 4–7 may have at least one of a portion B contacted with a connecting portion of the third exhaust pipe sections 4*c*–7*c* to the catalyzers 8, 9 and a portion C contacted with the catalyzers 8, 9 themselves. Since the unit catalyzers 8, 9 receive much more heat from the exhaust pipes 4–7, the above-mentioned effect is more enhanced.

For example, the first exhaust pipe sections 4*a,* 7*a* and the second exhaust pipe sections 4*b,* 7*b* of the exhaust pipes 4, 7 may have both of the contacted portions B, C, and the second exhaust pipe sections 5*b,* 6*b* of the exhaust pipes 5, 6 may have the contacted portion C (FIGS. 2, 3)

Downstream sides of the unit catalyzers 8, 9 are connected to a single final collective exhaust pipe 10 as shown in FIG. 1. The collective exhaust pipe 10 extends rearward passing through a space formed between the group of the exhaust pipes 4, 7 and the group of the exhaust pipes 5, 6 and has an end connected to a muffler 11.

Another end of the collective exhaust pipe 10 to be connected with the unit catalyzers 8, 9 is fixed to the main body of the engine by stay bolts 12 laying a buffer means between the pipe 10 and the unit catalyzers 8, 9. The stay bolts 12 support downstream sides of the exhaust manifold 3 and the unit catalyzers 8, 9.

According to the embodiment I, in a catalyzer arrangement in an exhaust system of a multi-cylinder internal combustion engine having a plurality of exhaust pipes connected with exhaust ports of the engine, each of the exhaust pipes 4–7 has a first exhaust pipe section 4*a*–7*a* extending from a main body of the engine, a second exhaust pipe section 4*b*–7*b* contiguous to the first exhaust pipe section 4*a*–7*a* having a first curved portion 4*k*–7*k* for turning the second exhaust pipe section toward the main body of the engine, and a third exhaust pipe section 4*c*–7*c* contiguous to the second exhaust pipe section 4*b*–7*b* having a second curved portion 41–71 for turning the third exhaust pipe section away from the main body of the engine, and a catalyzer 8, 9 is connected to a downstream sides of the third exhaust pipe section 4*c*–7*c* and disposed within a space A surrounded by the first, second and third exhaust pipe sections.

As the result, since the catalyzer 8,9 is disposed within the space A surrounded by the first exhaust pipe section 4*a*–7*a,* the second exhaust pipe section 4*b*–7*b* having the first curved portion 4*k*–7*k,* and the third exhaust pipe section 4*c*–7*c* having the second curved portion 41–71, pipe length of the exhaust pipe 4–7 can be set freely within a space limited by breadth of the engine 1, by suitably selecting curvature of the curved portion. Therefore, the exhaust pipe length can be matched with valve timing or the like easily, an exhaust pipe length sufficient for reducing exhaust gas interference accompanying high output of the engine can be ensured easily so that output of the engine can be made high.

The catalyzer 8, 9 can be disposed within the space limited by breadth of the engine utilizing a dead space with high space efficiency and a sufficient catalyzer capacity can be ensured easily by adjusting curvature of the curved portion 4*k*–7*k,* 41–71. Therefore, emission can be lowered easily and emission deterioration characteristic is improved because thermal load per one catalyzer is reduced.

The distance from the exhaust port of the engine 1 to the catalyzer 8, 9 becomes long, but since the catalyzer 8, 9 is surrounded by the exhaust pipes 4–7 and receives heat from the exhaust pipes, time required for the catalyzer 8, 9 to reach the minimum active temperature is not prolonged even if the engine is started at a low temperature. Therefore, exhaust emission can be reduced.

Further, in the embodiment I, the exhaust pipes 4–7 are divided into one group positioned near one end of the row of cylinder and another group positioned near another end of the row of cylinder, the catalyzer 8, 9 is divided into one unit catalyzer 8 positioned near one end of the row of cylinder and another unit catalyzer 9 positioned near another end of the row of cylinder, the one group of cylinders 4, 7 is connected to the one unit catalyzer 8, and the another group of cylinders 5, 6 is connected to the another unit catalyzer 9.

As the result, since the both unit catalyzers 8, 9 deteriorate equally and each catalyzer deteriorates uniformly, endurance of the catalyzer 8, 9 is improved to enable to utilize the catalyzer efficiently.

In the embodiment I, at least one of the first and second exhaust pipe sections 4*a*–7*a,* 4*b*–7*b* has a portion B, C contacted with at least one of a connecting portion of the third exhaust pipe section 4*c*–7*c* to the unit catalyzers 8, 9 and the unit catalyzers 8, 9 themselves.

As the result, since the unit catalyzers 8, 9 receive heat from exhaust gas on an upstream side of the unit catalyzers 8, 9 more efficiently by thermal conduction through the cantacted portion B, C, active temperature of the unit catalyzers 8, 9 can be maintained surely, time required for the unit catalyzer 8, 9 to reach the minimum active temperature is shortened, and exhaust emission is lowered more.

All of the first curved portins 4*k*–7*k* of the exhaust pipes 4–7 are formed so that the exhaust pipes 4–7 turn toward the main body of the engine while extending from above to bottom.

As the result, the space A for disposing the unit catalyzers 8, 9 comes near a heated portion of the main body of the engine so that the unit catalyzers 8, 9 receive much more heat from the main body of the engine, time required for the unit catalyzers 8, 9 to reach the minimum active temperature is more shortened and exhaust emission is further lowered. In addition, entire construction of the exhaust pipes including the final collective exhaust pipe 10 can be made compact and the unit catalyzers 8, 9 are supported stably.

Figure 8:
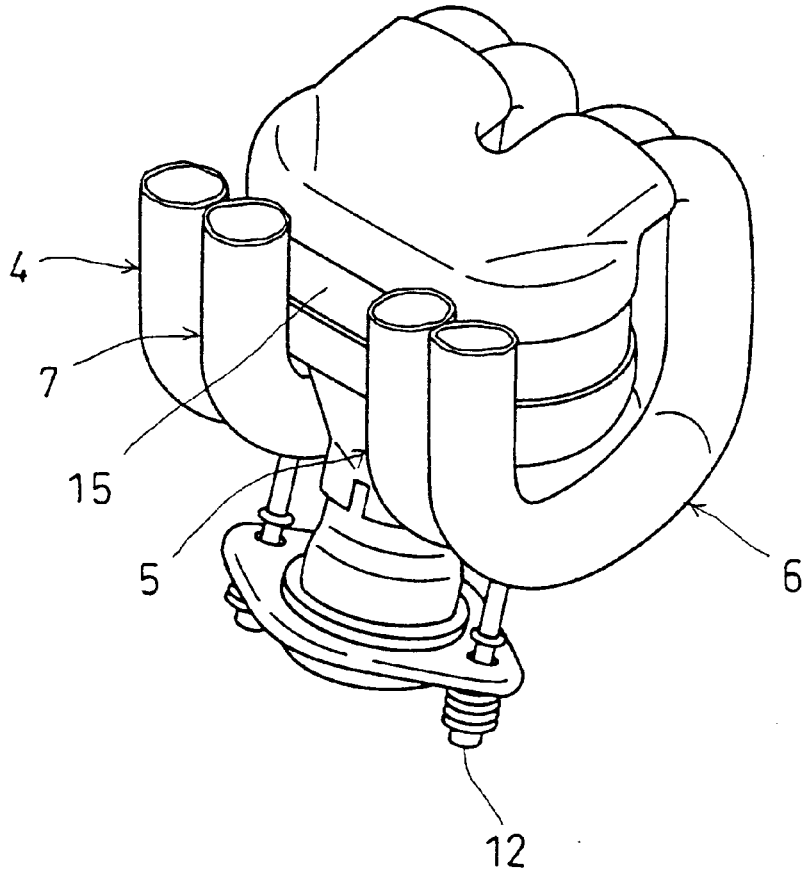
FIG. 8 is a view corresponding to FIG. 6 showing a modification of the catalyzer construction.

The unit catalyzers 8, 9 in the embodiment I may be integrally joined into a single catalyzer 15 as shown in FIG. 8. Also in this case, connection of the exhaust pipes 4–7 to the catalyzer 15 is basically the same as connection to the unit catalyzers 8, 9.

Next, another embodiment (embodiment II) of the present invention shown in FIGS. 9–12 will be described.

Figure 9:
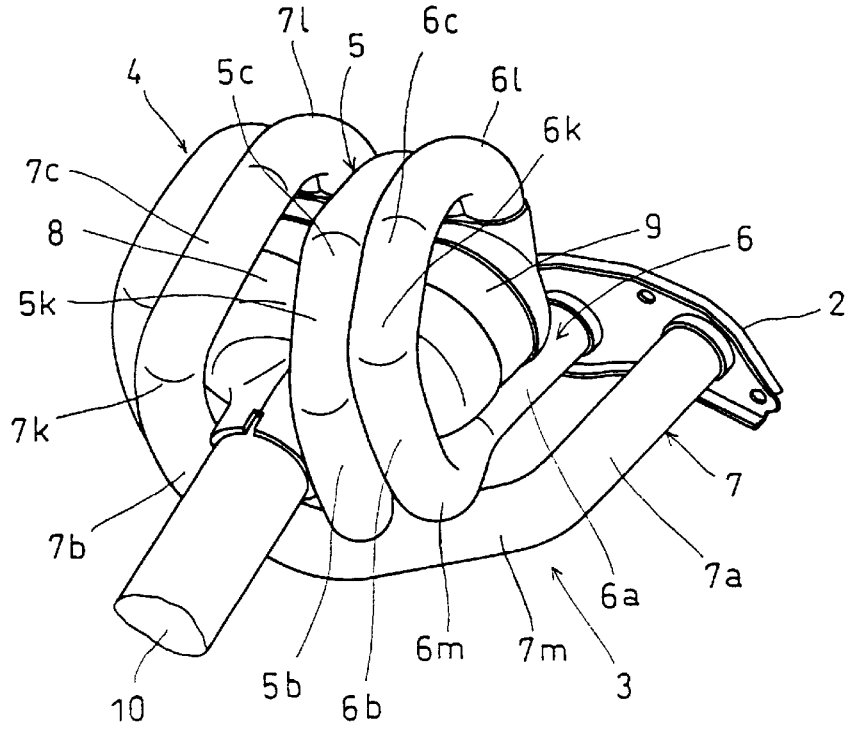
FIG. 9 is a perspective view of a catalyzer arrangement in an exhaust system of a multi-cylinder internal combustion engine according to the second embodiment of the present invention (embodiment II)
Figure 10:
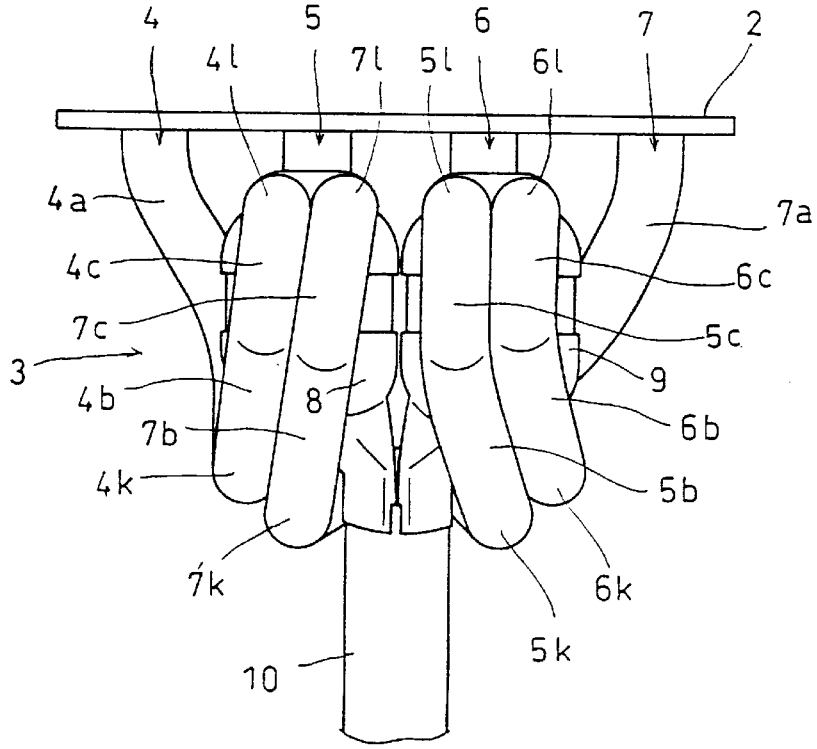
FIG. 10 is a plan view thereof.
Figure 11:
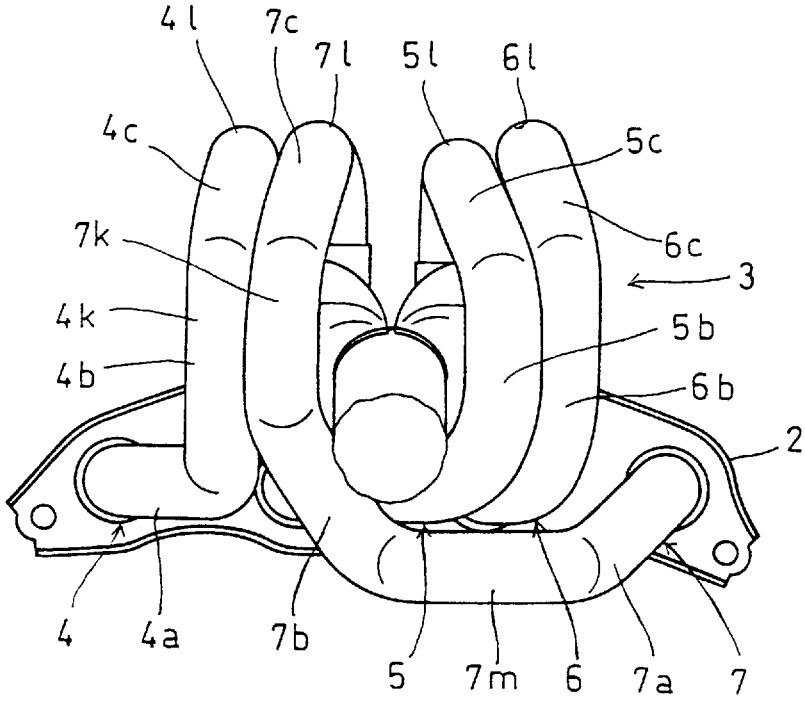
FIG. 11 is a rear view thereof.
Figure 12:
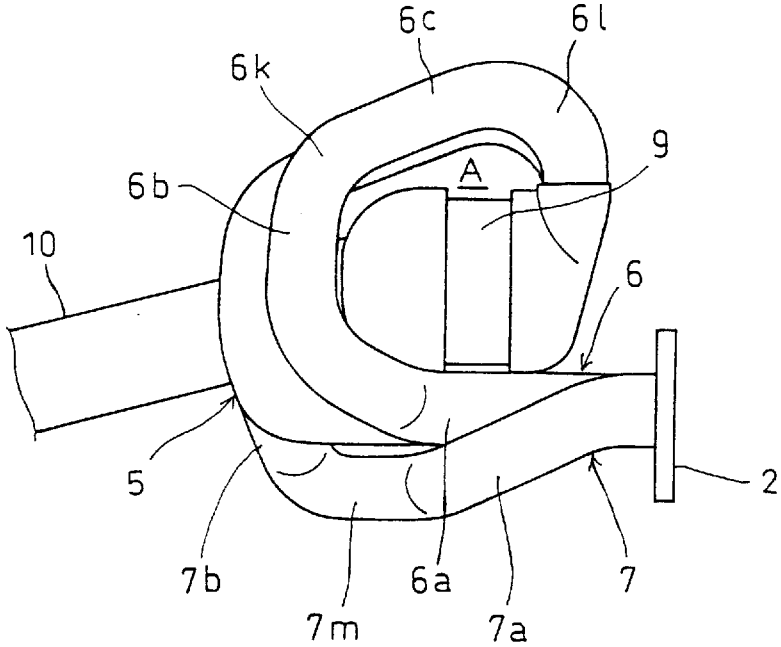
FIG. 12 is a right side view of FIG. 11.

FIG. 9 is a perspective view of a catalyzer arrangement in a exhaust system of a multi-system internal combustion engine according to the embodiment II, FIG. 10 is a plan view thereof, FIG. 11 is a rear view thereof and FIG. 12 is a right side view of FIG. 11.

The catalyzer arrangement of the embodiment II is different from the catalyzer arrangement of the embodiment I in turning direction of the first curved portions 4*k*–7*k*.

Namely, in the embodiment I the exhaust pipes 4–7 extend from top to bottom at the curved portions 4*k*–7*k,* but in the embodiment II the exhaust pipes 4–7 extend from bottom to top at the curved portions 4*k*–7*k*.

As the result, the space A for disposing the unit catalyzers 8, 9 surrounded by the first exhaust pipe sections 4*a*–7*a,* the second exhaust pipe sections 4*b*–7*b* and the third exhaust pipe sections 4*c*–7*c* of the exhaust pipes 4–7 is positioned at a distance upward from the heated portion of the main body of the engine. And an end of the final collective exhaust pipe 10 near the unit catalyzers 8, 9 is formed so as to extend once rearward away from the main body of the engine and then downward and rearward.

The embodiment II is different from the embodiment I also in that the curved portions 4*n*–7*n* of the exhaust pipes 4–7 are disappeared, but with respect to the other points there is no difference between the embodiments I and II, therefore a further detailed description of the embodiment II is omitted.

In the embodiment II, the space A for disposing the catalyzer 8, 9 is positioned at a distance upward from the heated portion of the main body of the engine as stated above, but since the catalyzer 8, 9 is exposed to the open air to be cooled rather than it receives heat from the heated portion of the main body of the engine, durability of the catalyzer is improved. For the rest, the embodiment II exhibits effects similar to those of the embodiment I.

FIGS. 13 to 16 show a further embodiment (embodiment III) of the present invention.

Figure 13:
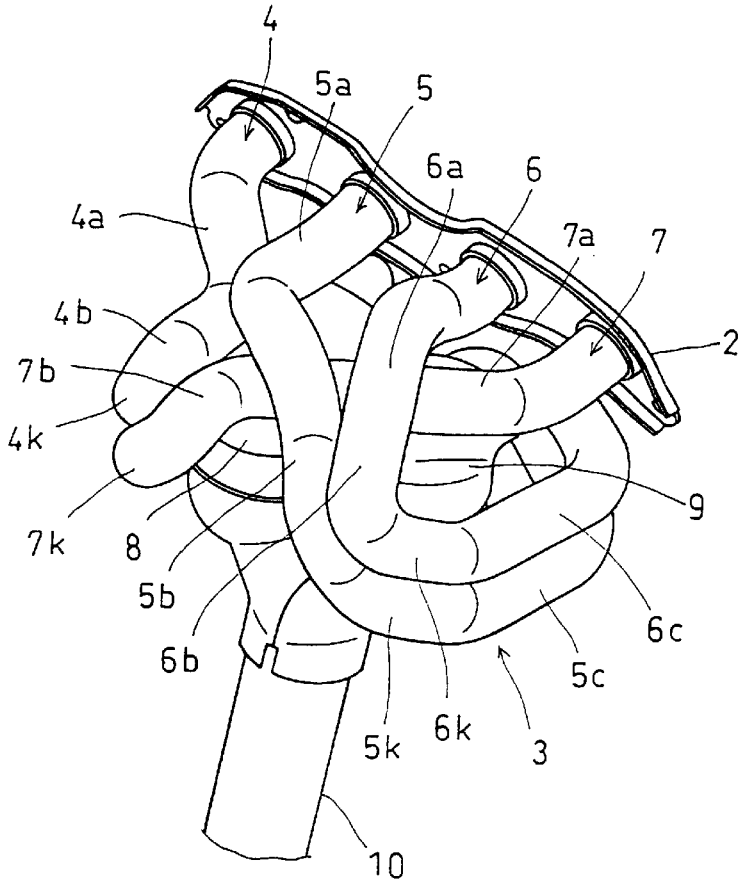
FIG. 13 is a perspective view of a catalyzer arrangement in an exhaust system of a multi-cylinder internal combustion engine according to the third embodiment of the present invention (embodiment III)
Figure 14:
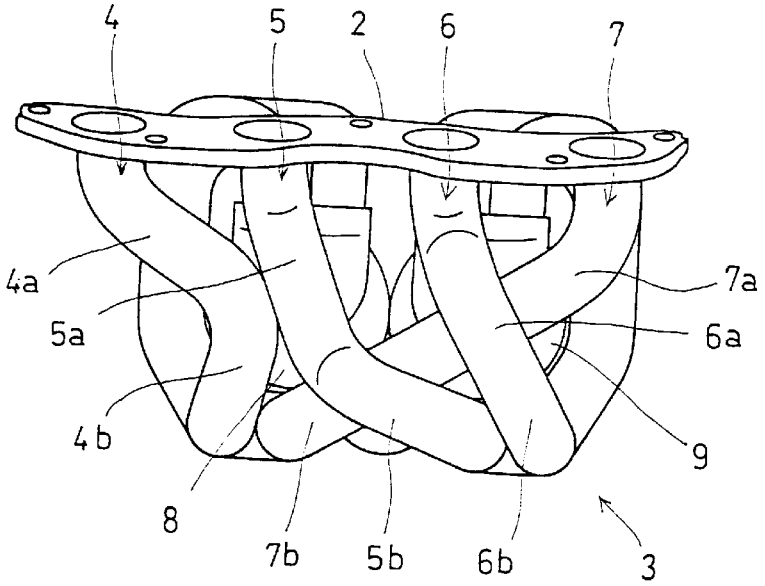
FIG. 14 is a plan view thereof.
Figure 15:
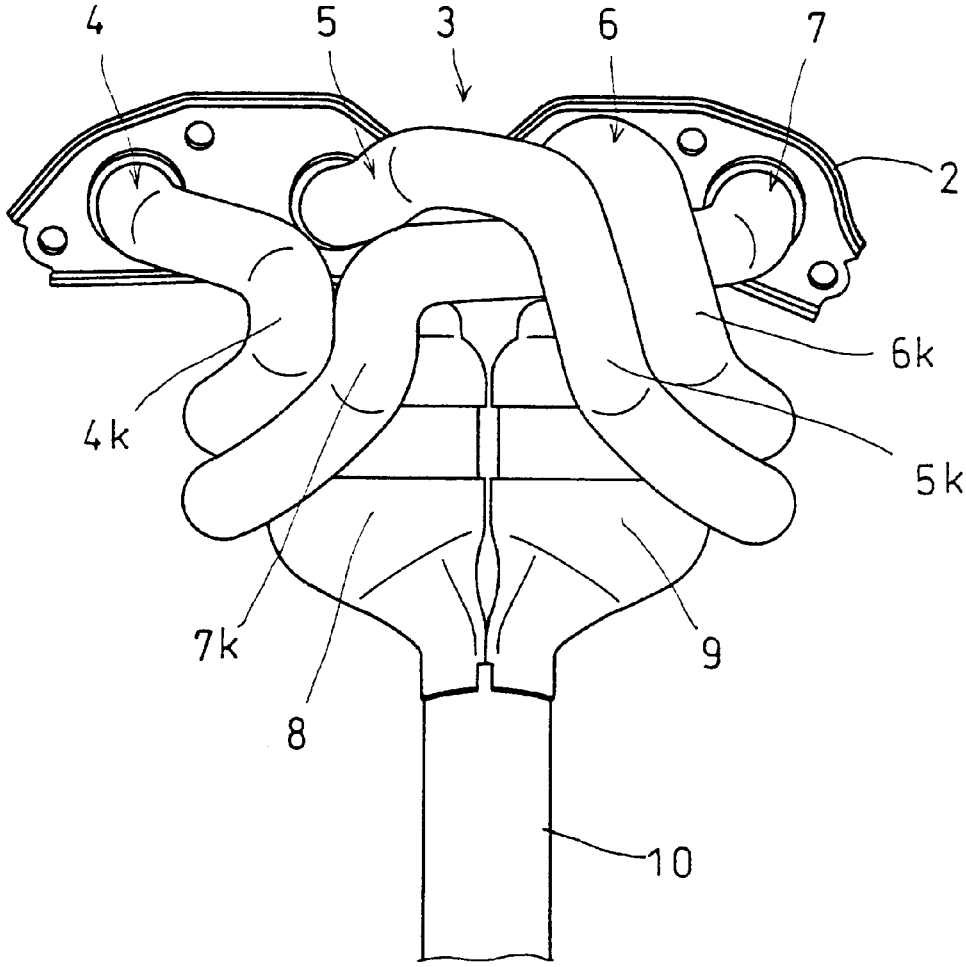
FIG. 15 is a rear view thereof.
Figure 16:
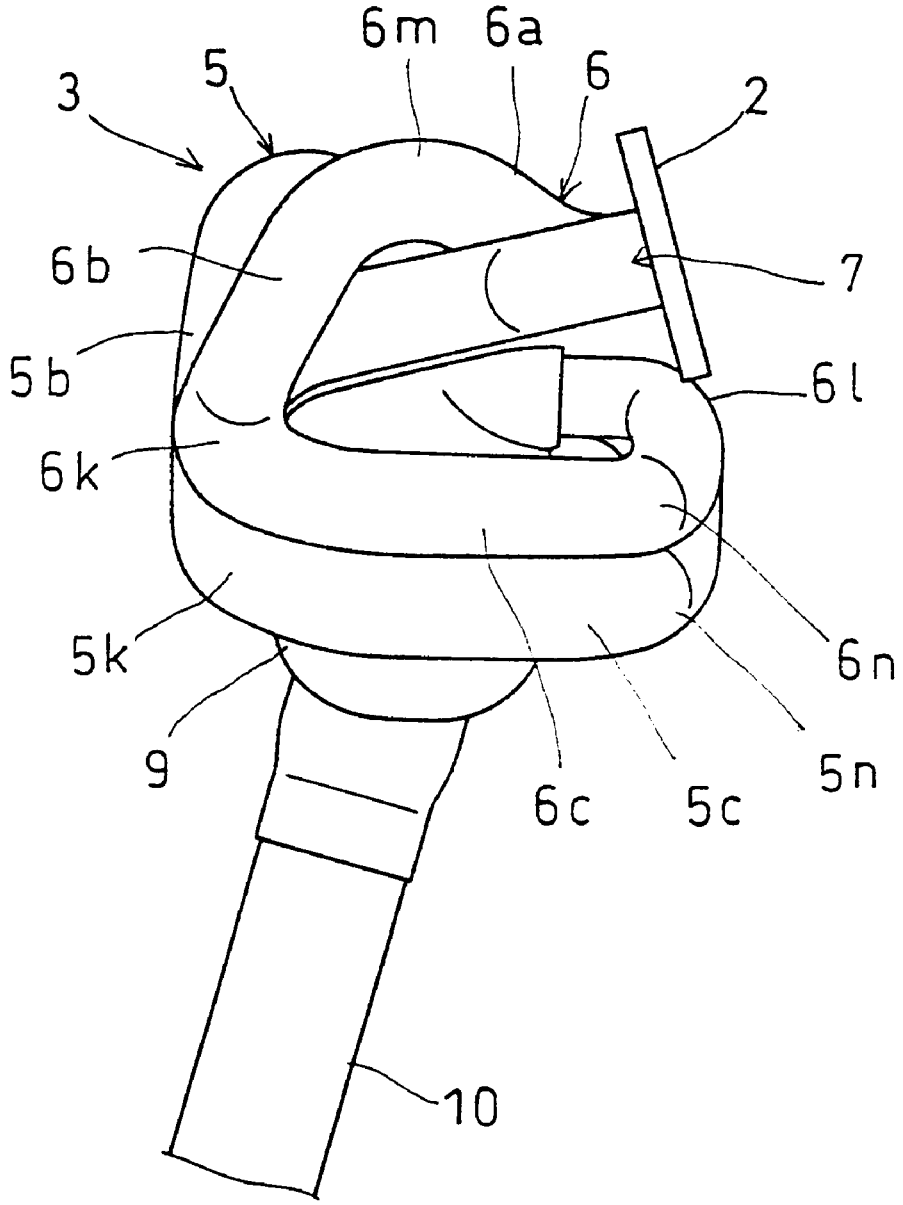
FIG. 16 is a right side view of FIG. 15.

FIG. 13 is a perspective view of a catalyzer arrangement in a exhaust system of a multi-cylinder internal combustion engine according to the embodiment III, FIG. 14 is a plan view thereof, FIG. 15 is a rear view thereof and FIG. 16 is a right side view of FIG. 15.

The catalyzer arrangement of the embodiment III is different from the catalyzer arrangement of the embodiment I in turning direction of the first curved sections 4*k*–7*k*.

Namely, in the embodiment I all of the exhaust pipes 4–7 extend from top to bottom at the curved portions 4*k*–7*k*, but in the embodiment III the exhaust pipes 4, 7 extend from top to bottom obliquely toward one side at the curved portions 4*k*, 7*k*, and the exhaust pipes 5, 6 extend from top to bottom obliquely toward another side at the curved portions 5*h*, 6*h*.

As the result, the space A is formed in a shape opened downward so as to cover the catalyzer 8, 9 from above and both sides.

For the rest, there is no difference between the embodiments I and the embodiment III. Therefore, a further detailed description of the embodiment III is omitted.

In the embodiment III, similarly to the embodiment I, the space A can be formed near the heated portion of the main body of the engine, so that time required for the catalyzer to reach the maximum active temperature does not prolonged, and exhaust emission is reduced. Further, the exhaust manifold section holding the catalyzer 8, 9 can be made compact compared with the embodiment I while the embodiment III exhibits effects similar to those of the embodiment I.

The embodiment III may be modified so that the exhaust pipes 4, 7 extend from bottom to top obliquely toward one side at the curved portions 4*k*, 7*k*, and the exhaust pipes 5, 6 extend from bottom to top obliquely toward another side at the curved portions 5*k*, 6*k* (illustration is omitted).

In this modification, similarly to the embodiment II, the space for disposing the catalyzer 8, 9 surrounded by the first exhaust pipe sections 4*a*–7*a*, the second exhaust pipe sections 4*b*–7*b* and the third exhaust pipe sections 4*c*–7*c* of the exhaust pipes 4–7 is positioned at a distance upward from the heated portion of the main body of the engine, and an end of the final collective exhaust pipe 10 near the unit catalyzers 8, 9 is formed so as to extend once rear ward away from the main body of the engine and then downward and rearward.

The catalyzer 8, 9 disposed in the space A positioned at a distance upward from the heated portion of the main body of the engine is exposed to the open air to be cooled rather than it receives heat from the heated portion, therefore durability of the catalyzer 8, 9 is improved. For the rest, this modification exhibits effects similar to those of the embodiment III.

FIGS. 17 to 20 show a fourth embodiment (embodiment IV) of the present invention.

Figure 17:
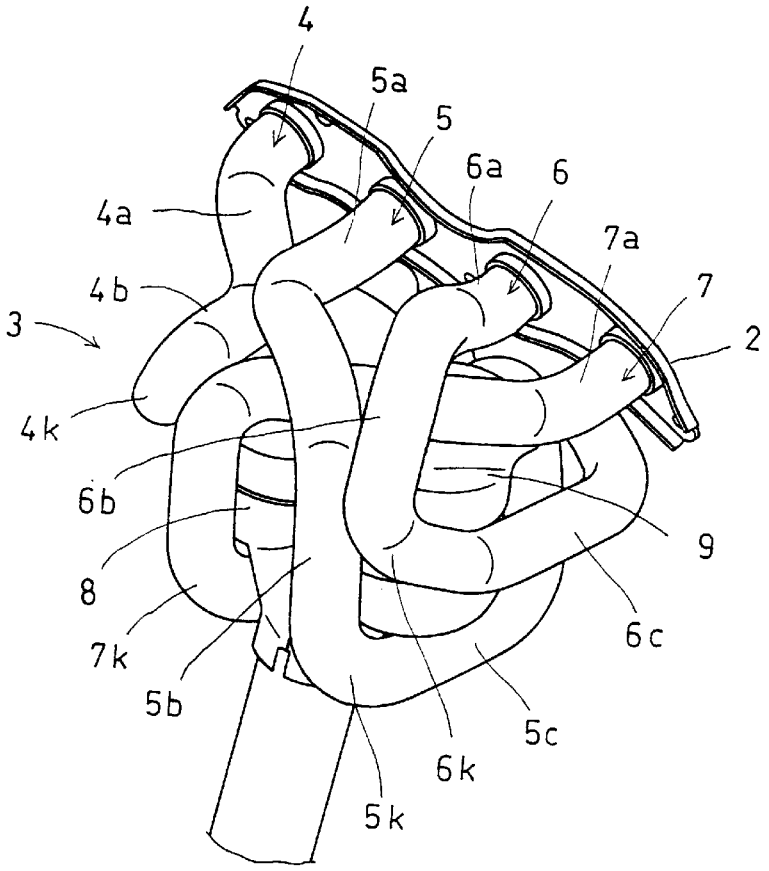
FIG. 17 is a perspective view of a catalyzer arrangement in an exhaust system of a multi-cylinder internal combustion engine according to the fourth embodiment of the present invention (embodiment IV)
Figure 18:
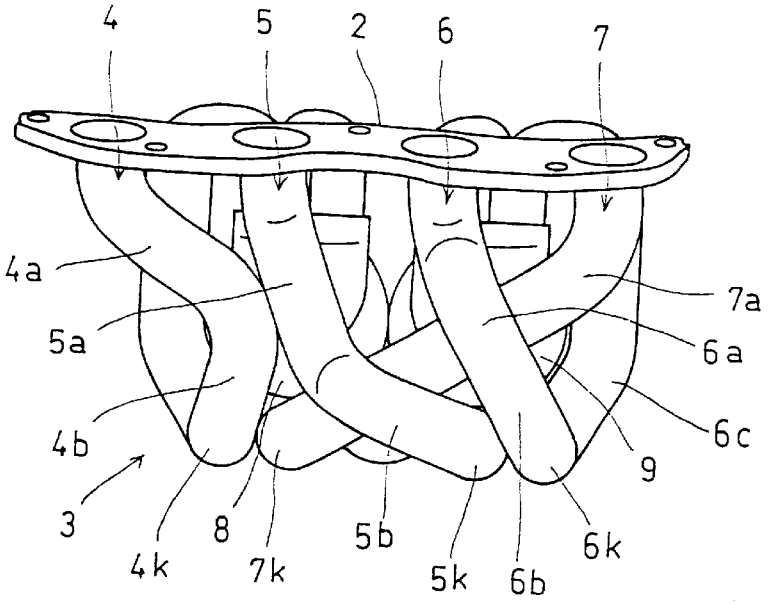
FIG. 18 is a plan view thereof.
Figure 19:
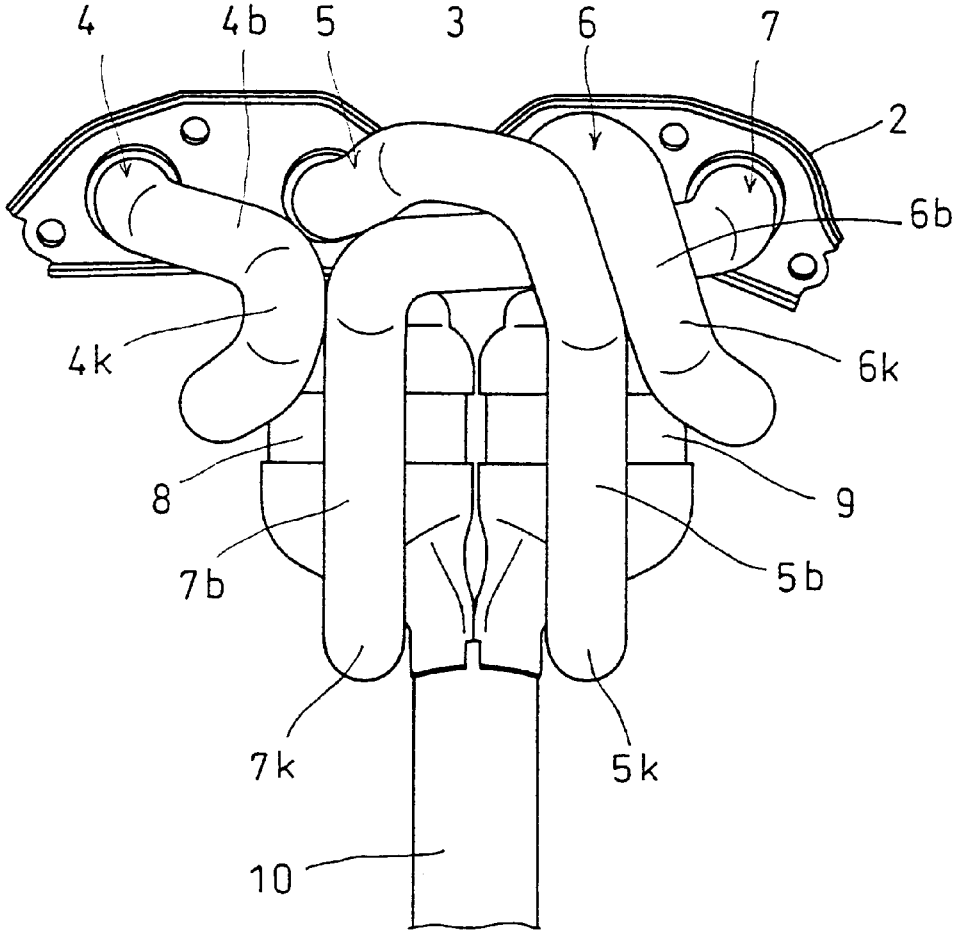
FIG. 19 is a rear view thereof.
Figure 20:
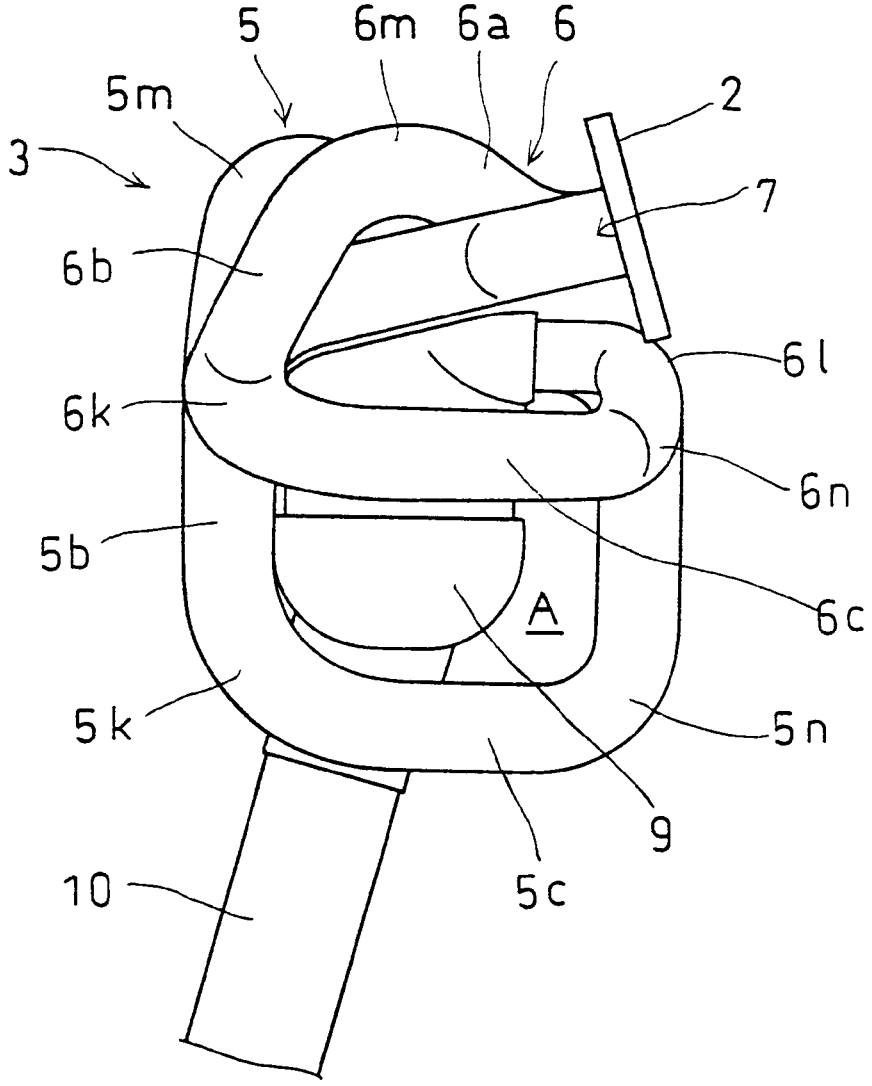
FIG. 20 is a right side view of FIG. 19.

FIG. 17 is a perspective view of a catalyzer arrangement in an exhaust system of a multi-cylinder internal combustion engine according to the embodiment IV, FIG. 18 is a plan view thereof, FIG. 19 is a rear view thereof and FIG. 20 is a right side view of FIG. 19.

As shown in FIGS. 17 to 20, the catalyzer arrangement of the embodiment IV is different from the catalyzer arrangement of the embodiment I in turning directions of the first curved portions 4*k*–7*k*.

Namely, in the embodiment I, the exhaust pipes 4–7 extend from top to bottom at the curved portions 4*k*–7*k*. Compared with this, in the embodiment IV, the exhaust pipe 7 extends from top to bottom turning toward the main body of the engine at the first curved portion 7*k*, the exhaust pipe 4 extends from top to bottom turning toward one side and the main body of the engine at the first curved portion 4*k*, the exhaust pipe 5 extends from top to bottom turning toward the main body of the engine at the first curved portion 5*k*, and the exhaust pipe 6 extend from top to bottom turning toward another side and the main body of the engine at first curved portion 6*k*.

As the result, the exhaust pipes 7, 5 surround the catalyzer 8, 9 from top, bottom and rear, and the exhaust pipes 4, 6 surround the catalyzer 8, 9 from top and both sides.

For the rest, there is no difference between the embodiment IV and the embodiment I, therefore a further detailed description of the embodiment IV is omitted.

According to the embodiment IV, the space A for disposing the catalyzer 8, 9 can be formed at a position near the heated portion of the main body of the engine, so that the catalyzer 8, 9 receive heat from the exhaust pipes 4–7 and the main body of the engines to restrain the time required for reaching the minimum active temperature from being prolonged and reduce exhaust emission. The embodiment IV can exhibit effects similar to those of the embodiment I. In addition, according to the embodiment IV, the exhaust manifold section holding the catalyzer 8, 9 can be constructed more compactly and the catalyzer 8, 9 can be held more surely, compared with the embodiment I.

Also in the embodiment IV, similarly to the embodiment III, turning direction of the exhaust pipes 4–7 at the first curved portions 4*k*–7*k* can be reversed so as to extend from bottom to top. In this modification, the space A for disposing the catalyzer 8, 9 surrounded by the first exhaust pipe sections 4*a*–7*a*, the second exhaust pipe sections 4*b*–7*b* and the third exhaust pipe sections 4*c*–7*c* of the exhaust pipes 4–7 is positioned at a distance upward from the heated portion of the main body of the engine, and an end of the final collective exhaust pipe 10 near the unit catalyzers 8, 9 is formed so as to once extend rearward away from the main body of the engine and then curve downward.

The catalyzer 8, 9 disposed in the space A positioned at a distance upward from the heated portion of the main body of the engine is exposed to the open air to be cooled rather than it receives heat from the heated portion, therefore durability of the catalyzer 8, 9 is improved. For the rest, this modification exhibits effects similar to those of the embodiment IV.

FIGS. 21 to 25 show a fifth embodiment (embodiment V) of the present invention.

Figure 21:
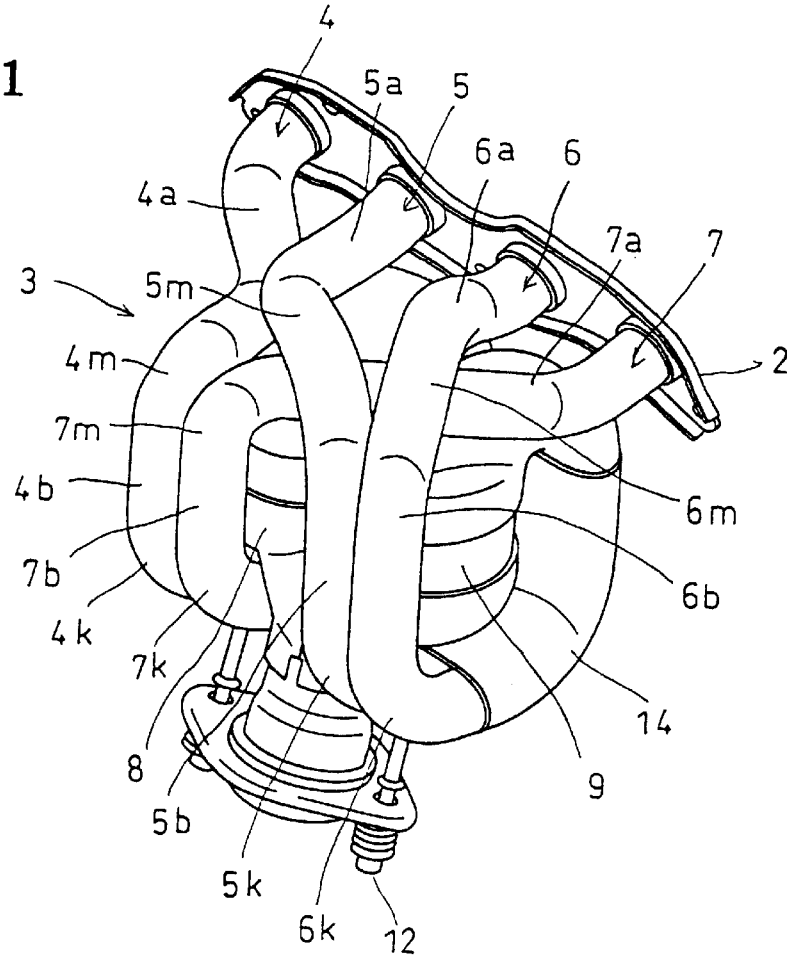
FIG. 21 is a perspective view of a catalyzer arrangement in an exhaust system of a multi-cylinder internal combustion engine according to the fifth embodiment of the present invention (embodiment V)
Figure 22:
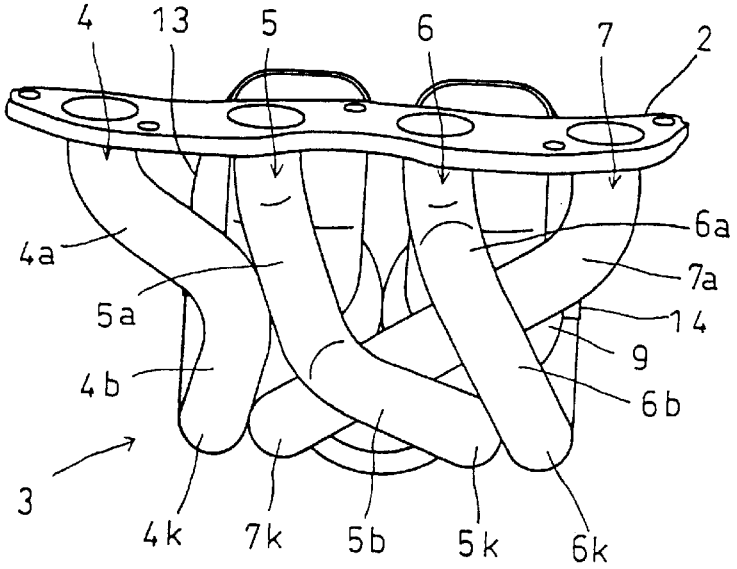
FIG. 22 is a plan view thereof.
Figure 23:
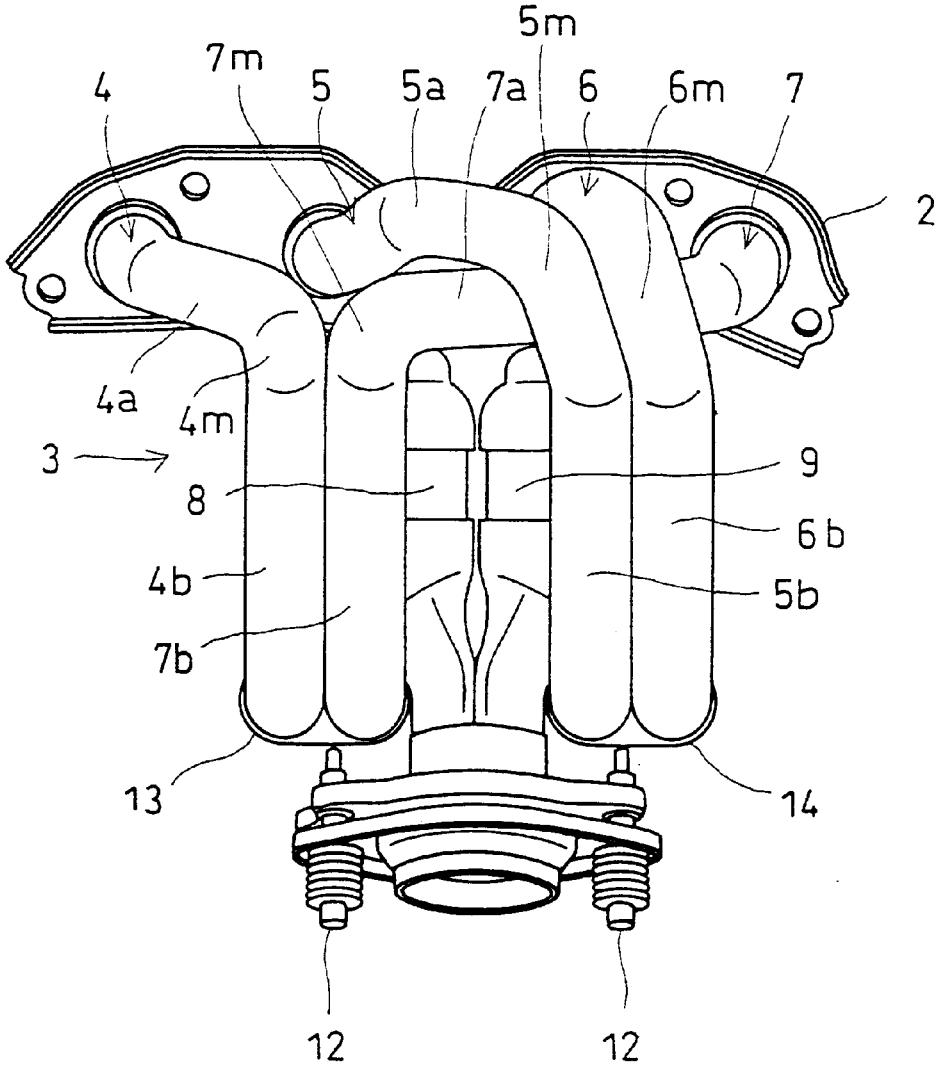
FIG. 23 is a rear view thereof.
Figure 24:
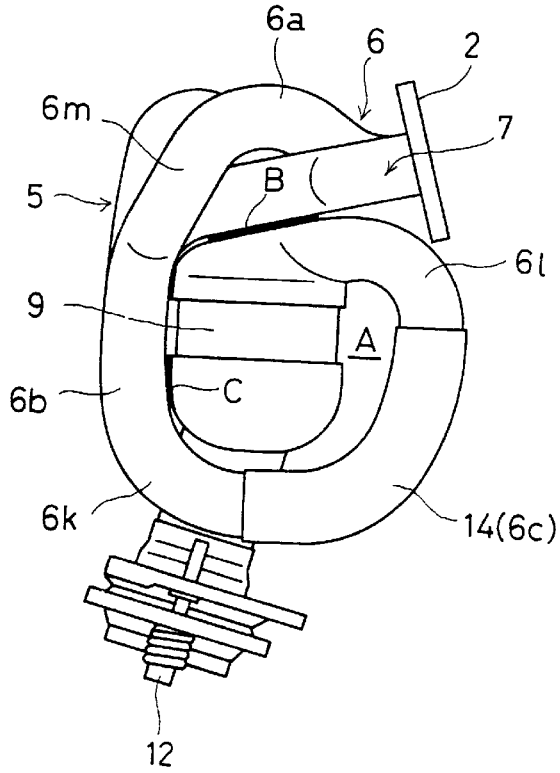
FIG. 24 is a right side view of FIG. 23.
Figure 25:
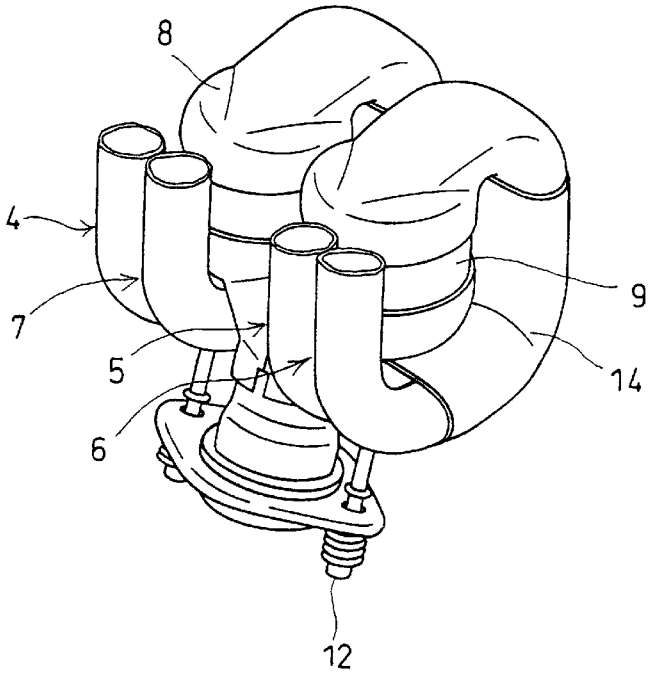
FIG. 25 is a partial perspective view of the catalyzer arrangement corresponding to FIG. 6.

FIG. 21 is a perspective view of a catalyzer arrangement in an exhaust system of a multi-cylinder internal combustion engine according to the embodiment V, FIG. 22 is a plan view thereof, FIG. 23 is a rear view thereof, FIG. 20 is a right side view of FIG. 19 and FIG. 15 is a partial perspective view of the same catalyzer arrangement.

As shown in FIGS. 21 to 24, the catalyzer arrangement of the embodiment V is different from the catalyzer arrangement of the embodiment I in that the exhaust pipes 4, 7 are collected into a collective exhaust pipe 13 at portions extending over the second exhaust pipe sections 4*b*, 7*b* and the third exhaust pipe sections 4*c*, 7*c* or at the third exhaust pipe sections 4*c*, 7*c*, and the exhaust pipes 5, 6 are collected into a collective exhaust pipe 14 at portions extending over the second exhaust pipe sections 5*b*, 6*b* and the third exhaust pipe sections 5*c*, 6*c* or at the third exhaust pipe sections 5*c*, 6*c*.

The position where the exhaust pipes 4, 7 are collected into the collective exhaust pipe 13 and the position where the exhaust pipes 5, 6 are collected into the collective exhaust pipe 14 are suitably decided so that length of each of the exhaust pipes 4–7 up to the collective exhaust pipe 13 or 14 (each single exhaust pipe length of the exhaust manifold 3) is sufficient to reduce exhaust gas interference accompanying high output of the engine 1. In the catalyzer arrangement shown in FIGS. 21 to 24, the exhaust pipes 4–7 are collected into the collective exhaust pipes 13, 14 about at the third exhaust pipe sections 4*c*–7*c*.

The catalyzer is divided into an unit catalyzer 8 disposed near one end of the row of cylinder of the engine 1 and another unit catalyzer 9 disposed near another end of the row of cylinder, and the collective exhaust pipe 13 collecting the exhaust pipes 4, 7 disposed near one end of the row of cylinder is connected to the unit catalyzer 8 and the collective exhaust pipe 14 collecting the exhaust pipes 5, 6 disposed near another end of the row of cylinder is connected to the unit catalyzer 9. The unit catalyzers 8, 9 may be joined integrally as shown in FIG. 8.

At least one of the first exhaust pipe sections 4*a*–7*a* and the second exhaust pipe sections 4*b*–7*b* is contacted with at least one of the connecting portions of the collective exhaust pipes 13, 14 to the catalyzer 8, 9 and the catalyzer itself.

For the rest, there is no difference between the embodiment V and the embodiment I, therefore a further description of the embodiment V is omitted.

According to the embodiment V, each single exhaust pipe length of the exhaust manifold 3 can be set freely by variously changing the positions where the exhaust pipes 4, 7 and the exhaust pipes 5, 6 are collected into respective collective exhaust pipes 13, 14, so that matching with valve timing and the like can be obtained more easily, exhaust gas interference accompanying high output of the engine 1 is further reduced and output of the engine can be further raised.

The catalyzer is divided into the unit catalyzer 8 and the unit catalyzer 9, the collective exhaust pipe 13 positioned near one end of the row of cylinder is connected to the unit catalyzer 8 positioned near one end of the row of cylinder, and the collective exhaust pipe 14 positioned near another end of the row of cylinder is connected to the unit catalyzer 9 positioned near another end of the row of cylinder. As the result, since the both unit catalyzers 8, 9 deteriorate equally and each unit catalyzer deteriorates uniformly, durability of the catalyzers 8, 9 is improved to enable to utilize the catalyzer efficiently. For the rest, the embodiment V exhibits effects similar to those of the embodiment I.

FIGS. 26 to 29 show a sixth embodiment (embodiment VI) of the present invention.

Figure 26:
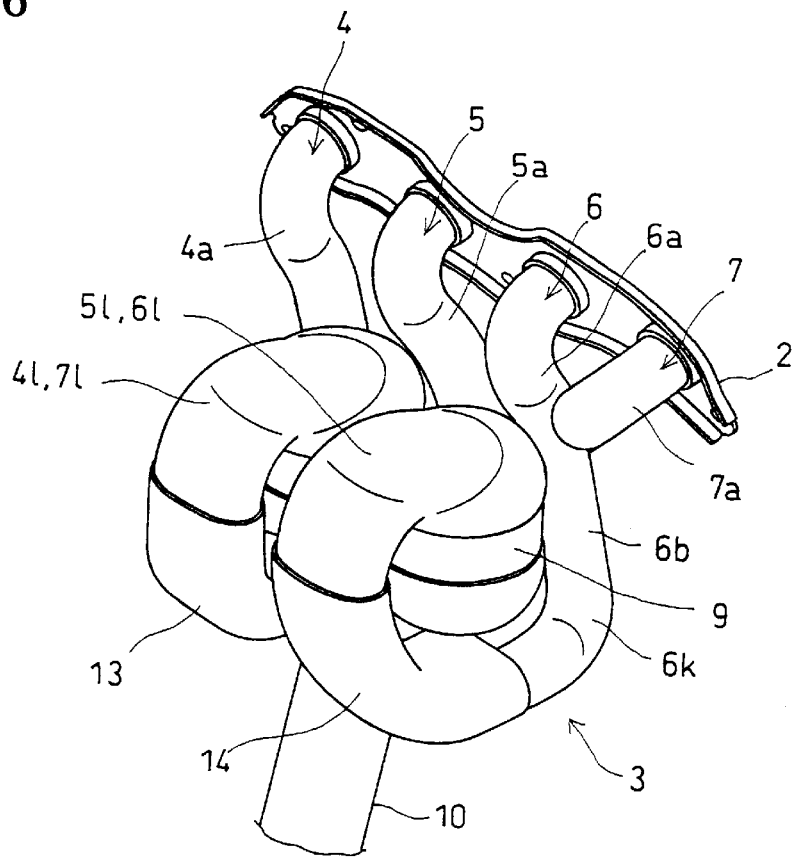
FIG. 26 is a perspective view of a catalyzer arrangement in an exhaust system of a multi-cylinder internal combustion engine according to the sixth embodiment of the present invention (embodiment VI)
Figure 27:
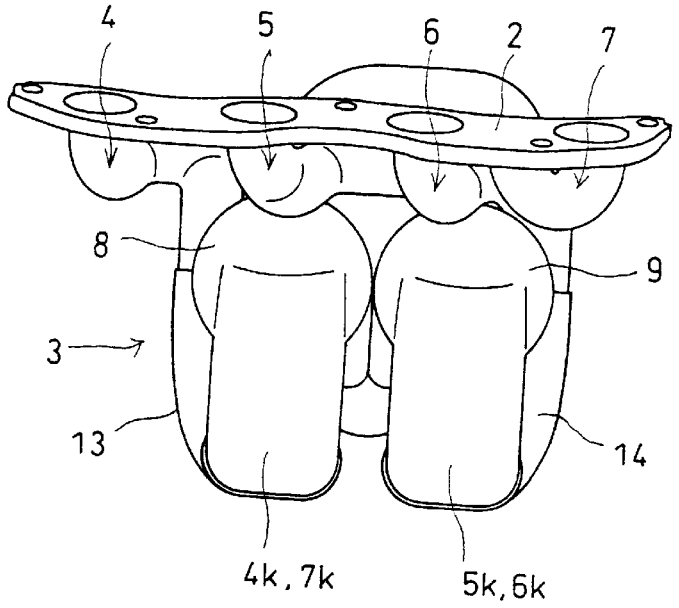
FIG. 27 is a plan view thereof.
Figure 28:
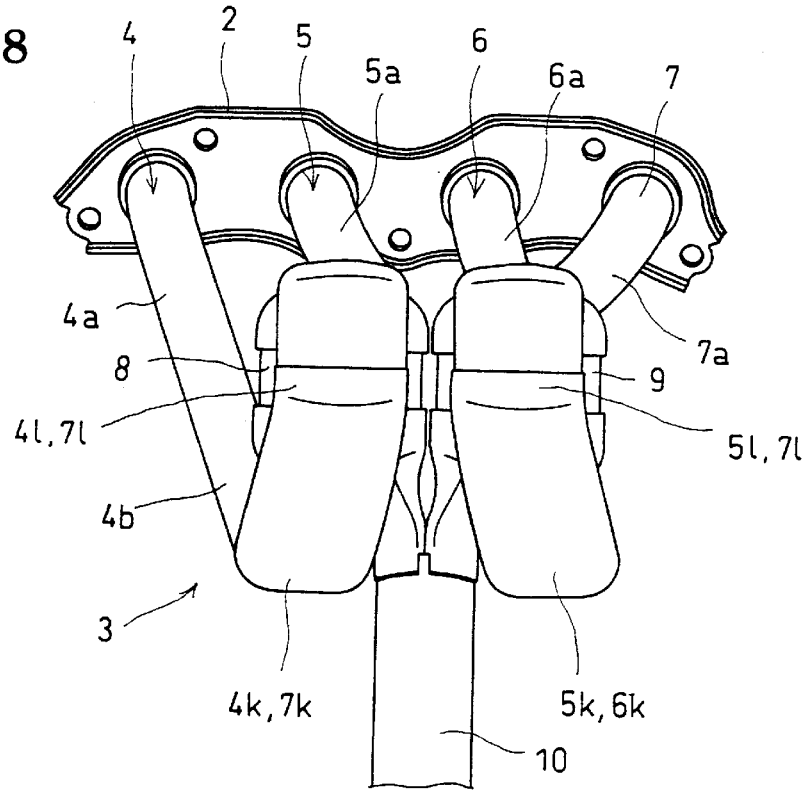
FIG. 28 is a rear view thereof.
Figure 29:
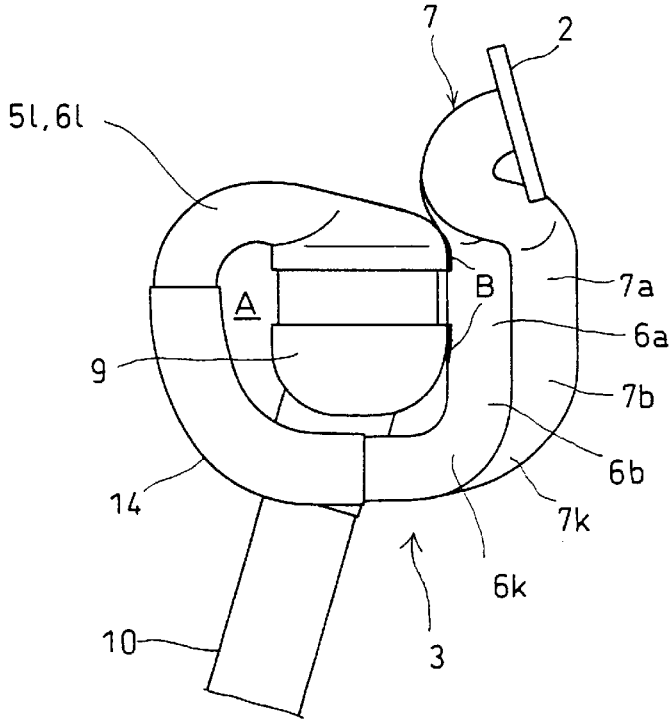
FIG. 29 is a right side view of FIG. 28.

FIG. 26 is a perspective view of a catalyzer arrangement in an exhaust system of a multi-cylinder internal combustion engine according to the embodiment VI, FIG. 27 is a plan view thereof, FIG. 28 is a rear view thereof and FIG. 29 is a right side view of FIG. 28.

As shown in FIGS. 26 to 29, the catalyzer arrangement of the embodiment VI is different from the embodiment V in directions of the first exhaust pipe sections 4*a*–7*a* of the exhaust pipes 4–7.

Namely, in the embodiment V the first exhaust pipe sections 4*a*–7*a* extend away from the main body of the engine, but in the embodiment VI the first exhaust pipe sections are bent downward and extend about in parallel with the main body of the engine. In addition, the embodiment VI is different from the embodiment V also in that curved portions 4*m*–7*m* are disappeared. However, also in the embodiment VI, the space surrounded by the first exhaust pipe sections 4*a*–7*a*, the second exhaust pipe sections 4*b*–7*b* and the third exhaust pipe sections 4*c*–7*c* is formed, and the exhaust pipes 4–7 are divide into two groups positioned near one and another end of the row of cylinder to be collected into respective collective exhaust pipes 13, 14. Thus the embodiment VI is basically the same as the embodiment V, therefore a further description of the embodiment VI is omitted.

In the embodiment VI, the first exhaust pipe sections 4*a*–7*a* are contacted with the catalyzer 8, 9 (FIG. 29). Also the second exhaust pipe sections 4*b*–7*b* may be contacted with the catalyzer 8, 9.

In the embodiment VI, since the first exhaust pipe sections are bent downward and extend about in parallel with the main body of the engine, construction of the exhaust manifold 3 is somewhat complicated, compared with the embodiments I–V. But the embodiment VI exhibits effects similar to those of the embodiment V.

In place of the collective exhaust pipes 13, 14 in the embodiment VI, each single second exhaust pipe sections 4*b*–7*b* and each single third exhaust pipe sections 4*c*–7*c* may be provided. The first exhaust pipe sections 4*a*–7*a* bent downward in the embodiment VI may be bent upward. Effects of these modifications can be understood easily from the embodiments I and II, therefore a further description of the modifications is omitted.

In the embodiments I–VI, the engine 1 has four cylinders, but the engine may have more cylinders.

What is claimed is:

1. A catalyzer arrangement in an exhaust system of a multi-cylinder internal combustion engine having a plurality of exhaust pipes connected with exhaust ports of the engine, wherein each of said exhaust pipes has a first exhaust pipe section extending away from a main bode of said engine; a second exhaust pipe section contiguous to said first exhaust pipe section having a first curved portion for turning said second exhaust pipe section toward said main body of the engine; and a third exhaust pipe section contiguous to said second exhaust pipe section having a second curved portion for turning said third exhaust pipe section away from said main body of the engine, and said catalyzer is connected to a downstream side of said third exhaust pipe section and disposed within a space surrounded by said first, second and third exhaust pipe sections.

2. A catalyzer arrangement as claimed in claim 1, wherein said exhaust pipes are divided into one group positioned near one end of a row of cylinder of the engine and another group positioned near another end of said row of cylinder, said catalyzer is divided into one unit catalyzer positioned near one end of said row of cylinder and another unit catalyzer positioned near another end of said row of cylinder, said one group of cylinders is connected to said one unit catalyzer, and said another group of cylinders is connected to said another unit catzlyzer.

3. A catalyzer arrangement as claimed in claim 1 or 2, wherein at least one of said first exhaust pipe section and said second exhaust pipe section has a portion contacted with at least one of a connecting portion of said third exhaust pipe section to said catalyzer and the catalyzer itself.

4. A catalyzer arrangement as claimed in claim 1, wherein said exhaust pipes are divided into one group positioned near one end of a row of cylinder of the engine and another group positioned near another end of said row of cylinder, and in each of said groups, two exhaust pipes are collected into a collective echaust pipe at a portion extending over said second and third exhaust pipe sections or at said third exhaust pipe section.

5. A catalyzer arrangement as claimed in claim 4, wherein said catalyzer is divided into one unit catalyzer positioned near one end of said row of cylinder and another unit catalyzer positioned near another end of said row of cylinder, said collective exhaust pipe in said one group is connected to said one unit catalyzer, and said collective exhaust pipe in said another group is connected to said another unit catalyzer.

6. A catalyzer arrangement as claimed in claim 4 or 5, wherein at least one of said first and second exhaust pipe sections has a portion contacted with at least one of a connecting portion of said collective exhaust pipe to said catalyzer and said catalyzer itself.

7. A catalyzer arrangement in an exhaust system of a multi-cylinder internal combustion engine having a plurality of exhaust pipes connected with exhaust ports of the engine, wherein each of said exhaust pipes has a first exhaust pipe section extending from a main body of said engine upward or downward in parallel with said main body; a second exhaust pipe section contiguous to said first exhaust pipe section having a first curved portion for turning said second exhaust pipe section away from said main body; and a third exhaust pipe section contiguous to said second exhaust pipe section having a second curved portion for turning said third exhaust pipe section toward said main body, and said catalyzer is connected to a downstream side of said third exhaust pipe section and disposed within a space surrounded by said first, second and third exhaust pipe sections.

* * * * *